US009352237B1

(12) United States Patent
Middleton

(10) Patent No.: US 9,352,237 B1
(45) Date of Patent: May 31, 2016

(54) TUMBLING TOY VEHICLE WITH A DIRECTIONAL BIAS

(76) Inventor: Lance Middleton, Soddy Daisy, TN (US)

( * ) Notice: Subject to any disclaimer, the term of this patent is extended or adjusted under 35 U.S.C. 154(b) by 501 days.

(21) Appl. No.: 13/534,548

(22) Filed: Jun. 27, 2012

Related U.S. Application Data

(60) Provisional application No. 61/501,424, filed on Jun. 27, 2011.

(51) Int. Cl.
*A63H 15/08* (2006.01)

(52) U.S. Cl.
CPC ..... *A63H 15/08* (2013.01)

(58) Field of Classification Search
CPC ..... A63H 11/00; A63H 11/08; A63H 15/00; A63H 15/08; A63H 29/08
USPC ..... 446/396, 431, 437, 457, 458, 489, 324, 446/445
See application file for complete search history.

(56) References Cited

U.S. PATENT DOCUMENTS

| | | | | | |
|---|---|---|---|---|---|
| 622,354 | A | | 4/1899 | Harvey | |
| 828,996 | A | * | 8/1906 | Ayers et al. | B08B 9/023 15/104.04 |
| 1,254,428 | A | * | 1/1918 | Myers | A63H 11/08 43/42.31 |
| 1,272,588 | A | | 7/1918 | White | |
| 1,494,963 | A | * | 5/1924 | Smith | A63H 3/005 273/108 |
| 1,614,471 | A | | 1/1927 | Hayashi | |
| 1,672,242 | A | * | 6/1928 | Bennett | A63H 15/08 446/324 |
| 2,218,207 | A | * | 10/1940 | Herzinger | A63H 11/08 446/324 |
| 2,585,780 | A | * | 2/1952 | Johnson | A63H 15/08 446/324 |
| 2,639,777 | A | | 5/1953 | Dull | |
| 2,751,707 | A | * | 6/1956 | Johannes | A63H 15/08 446/324 |
| 2,784,527 | A | | 3/1957 | Sarff | |
| 3,073,598 | A | * | 1/1963 | Tiikkainen | 273/341.1 |
| 3,519,273 | A | | 7/1970 | Viby | |
| 3,646,706 | A | | 3/1972 | Adickes | |
| 3,733,739 | A | | 5/1973 | Terzian | |
| 3,927,620 | A | | 12/1975 | Clapham | |
| 4,052,082 | A | | 10/1977 | Jones | |
| 4,076,263 | A | | 2/1978 | Rand | |
| 4,149,735 | A | | 4/1979 | Blackburn | |
| 4,168,076 | A | | 9/1979 | Johnson | |
| 4,213,266 | A | * | 7/1980 | Hyland | A63H 15/08 446/431 |
| 4,238,904 | A | | 12/1980 | Lang | |
| 4,257,605 | A | * | 3/1981 | Bancroft | F41J 9/02 273/109 |
| 4,288,088 | A | | 9/1981 | Harrison | |
| 4,314,422 | A | * | 2/1982 | Wexler | A63H 15/08 446/269 |
| 4,522,607 | A | | 6/1985 | Kilroy | |
| 4,564,162 | A | | 1/1986 | Grimm | |
| 4,568,305 | A | | 2/1986 | De Anda | |
| 4,599,077 | A | | 7/1986 | Vuillard | |
| 4,850,931 | A | | 7/1989 | Auer | |

(Continued)

FOREIGN PATENT DOCUMENTS

| | | |
|---|---|---|
| GB | 197110 | 5/1923 |

*Primary Examiner* — Gene Kim
*Assistant Examiner* — Alyssa Hylinski
(74) *Attorney, Agent, or Firm* — Maywood IP Law; G. Jo Hays; David W. Meibos

(57) ABSTRACT

An improved tumbling toy vehicle has a shape that is cambered from left to right to provide a directional bias toward the instantaneous lowest point on a play surface. When a play surface is manipulated by the user, the user can effectively control the speed and direction of the tumbling toy vehicle.

8 Claims, 29 Drawing Sheets

(56) References Cited

U.S. PATENT DOCUMENTS

| | | | | |
|---|---|---|---|---|
| 4,952,191 | A * | 8/1990 | Martinez | A63H 15/08 446/268 |
| 5,041,049 | A | 8/1991 | Wax | |
| 5,397,137 | A | 3/1995 | Pellegrini, Jr. | |
| 5,575,702 | A * | 11/1996 | Silvious | A63H 15/08 446/324 |
| 5,928,055 | A * | 7/1999 | Gramsch | A63H 15/08 446/297 |
| 6,071,173 | A | 6/2000 | Kelley | |
| 6,116,621 | A | 9/2000 | Flater | |
| 6,254,113 | B1 | 7/2001 | Dornan | |
| 6,273,436 | B1 | 8/2001 | Repucci | |
| 6,273,779 | B1 * | 8/2001 | Boulaire | A63H 15/08 446/169 |
| 6,367,828 | B1 | 4/2002 | Mandic | |
| 6,491,308 | B1 | 12/2002 | Bakx | |
| 6,508,335 | B2 | 1/2003 | Zinanti | |
| 6,568,695 | B2 | 5/2003 | Dornan | |
| 6,648,722 | B2 | 11/2003 | Lynders | |
| D590,894 | S | 4/2009 | Martino | |
| 8,047,556 | B2 | 11/2011 | Jang | |
| 8,226,096 | B2 | 7/2012 | Reyes, Jr. | |
| 8,522,928 | B2 | 9/2013 | Orcutt | |
| 8,550,870 | B2 | 10/2013 | Laurienzo | |
| 8,708,354 | B2 | 4/2014 | Young | |
| 8,910,958 | B2 | 12/2014 | Smith | |
| 2001/0052683 | A1 | 12/2001 | Vance | |
| 2002/0070514 | A1 | 6/2002 | Costa | |
| 2002/0153686 | A1 | 10/2002 | Todd | |
| 2004/0061295 | A1 | 4/2004 | Lester | |
| 2009/0149112 | A1 | 6/2009 | Clark, Jr. | |
| 2009/0256325 | A1 | 10/2009 | Dickie | |
| 2010/0081358 | A1 | 4/2010 | Yang | |
| 2010/0171280 | A1 | 7/2010 | Hadley | |
| 2011/0028069 | A1 | 2/2011 | Norman | |
| 2011/0079976 | A1 | 4/2011 | Seip | |
| 2012/0009846 | A1 | 1/2012 | Miller | |
| 2012/0091674 | A1 | 4/2012 | Kartalopoulos | |
| 2013/0026728 | A1 | 1/2013 | Genov | |
| 2013/0084774 | A1 | 4/2013 | Mimlitch, III | |
| 2013/0084775 | A1 | 4/2013 | Mimlitch, III | |
| 2013/0090037 | A1 | 4/2013 | Mimlitch, III | |
| 2013/0171910 | A1 | 7/2013 | Mimlitch, III | |

* cited by examiner

TUMBLING TOY VEHICLE WITH A DIRECTIONAL BIAS

CLAIM OF PRIORITY

This application claims the benefit of U.S. Provisional Patent Application No. 61/501,424 filed Jun. 27, 2011, incorporated in its entirety herein by reference.

FIELD OF THE INVENTION

The present invention relates to interactive toys with dynamic behavior, and more specifically, tumbling toys comprised of a body and a rolling mass for at least some embodiments adaptable to end-over-end motion and/or in a desired path on an incline.

BACKGROUND OF THE INVENTION

Tumbling toys, to include a hollow elongated body and an enclosed rolling mass, are well known. When placed on a play surface, these toys exhibit the ability to tumble downwardly, end-over-end in response to sufficient incline and gravity. The mechanism of tumbling is governed by the body's rounded ends and the ability for a mass, such as a metal ball, to freely shift from one end of the body to the other.

U.S. Pat. No. 622,354 issued to James A. Harvey on Apr. 4, 1899 describes a Puzzle consisting essentially of a box, two or more stalls, and a corresponding number of capsules, each containing a globular weight free to roll within the capsules. The puzzle is to manipulate the box in order to place the capsules in the various stalls. The small capsules are provided with paper legs or projections to render the movements of the capsule more lively and erratic and to prevent the capsules from rolling sideways.

U.S. Pat. No. 1,254,428 issued to Hubert A. Myers on Jan. 22, 1918 describes a Tumbling Toy having two flat, parallel sides each having an oval shape. A ball is enclosed within a central square tube which runs the length of the device. When placed on an inclined surface, the toy tumbles or rolls end-over-end of its own accord, as the ball is heavy enough to tilt the toy upright.

U.S. Pat. No. 1,272,588 issued to Thomas CCB White on Jul. 16, 1918 discloses a Tumbling Toy comprising a hollow elongated body with a square cross-section and oval sides. The ends of the body are rounded on its outer faces, with a spherical weight disposed within the body. When the toy is placed on an inclined plane, it will tumble downward, end-over-end produced by the effect of gravity on the ball.

U.S. Pat. No. 1,494,963 issued to Elbert L. Smith on May 20, 1924 describes a Container Toy which operates on the same general principle described above. The sides are flat and the ends are rounded. In addition, the toy includes oppositely disposed "feet," which affect the tumbling action. An openable flap is described by Smith, whereby a person may remove an article of candy or the like from within the hollow center, and replace it with a ball or marble with sufficient weight.

U.S. Pat. No. 1,614,471 issued to Andrew T. Hayashi on Jan. 18, 1927 describes a Japanese Peanut Ping Pong Game wherein a peanut shaped hollow container with a spherical mass therein, is released to travel randomly down a slope and trip a scoring switch or light at the end of its path. The peanut is generally realistically shaped having a substantially axisymmetric shape. Dimples on the outer surface are intended to replicate a peanut and provide random motion.

U.S. Pat. No. 3,519,273 issued to Jette Viby on Jul. 7, 1970 describes a Combined Tumbling Toy with Ribs and Ball wherein the axisymmetric housing or shell has a generally elliptical shape when viewed from the side and a circular shape when viewed from the end. Viby describes a shell having a mass less than that of the internal ball with internal ribs that stiffen the outer housing while providing a guide for the ball to roll back and forth within the shell.

U.S. Pat. No. 4,213,266 issued to Joseph F. Hyland et al. on Jul. 22, 1980 describes a Tumbling Toy having rounded ends and barrel shaped longitudinal portion. The Tumbling Toy is axisymmetric about the longitudinal axis with a circular cross-section. A weighted ball is free to travel within the hollow housing between the rounded ends. The Tumbling Toy is designed and weighted to tumble on an incline and to balance upright on a level surface. A narrow arcuate track with side walls to prevent the Tumbling Toy from rolling laterally is also disclosed.

U.S. Pat. No. 4,238,904 issued to Dorothy M. Lang on Dec. 16, 1980 describes a Toy Displaying Erratic Tumbling Movement, comprising a triangular shaped housing with a ball enclosed therein. The edges of the triangular housing are rounded to enable the device to turn from one side to the other as it moves down a slope. The apices of the triangle are open, but the openings are not sufficiently large to allow the mass contained therein to be removed.

U.S. Pat. No. 5,575,702 issued to Frances C. Silvious describes a Telescoping Tumbling Toy, comprising a housing and an enclosed mass, such as, a ball or cylinder. Two telescoping sections are connected to form the housing. The telescoping arrangement provides a means to explore different moments of inertia based on a selected length of the housing. The transverse cross-section disclosed is generally rectangular, with a height greater than the width. The telescoping members are separable to allow the enclosed mass to be exchanged with one of greater mass of lesser mass.

British Patent Publication No. 197,110 to Harry S. Kamiya and published on May 10, 1923 describes an Apparatus for Use in Playing a Game of Skill, wherein an elongated tumbling device has a hollow body with oval sides, further characterized by rectangular shape when viewed from an end. The object is to allow for the tumbling action and cause the tumbling device to drop into a hole in an inclined surface.

SUMMARY OF THE INVENTION

A preferred embodiment of an improved tumbling toy has a directional bias toward the instantaneous lowest point on a play surface. The tumbling toy has a functional shape, wherein at least a portion of the outer surface or outer surfaces are outwardly cambered from left to right. The functional shape, for at least some embodiments, provides a means for controlling the speed and/or direction of the tumbling toy on a user controlled play surface.

BRIEF DESCRIPTION OF THE DRAWINGS

The particular features and advantages of the invention as well as other objects will become apparent from the following description taken in connection with the accompanying drawings in which:

FIG. 10 further considers the relationship between surface camber and the center-of-gravity.

DETAILED DESCRIPTION

Figure 1A:
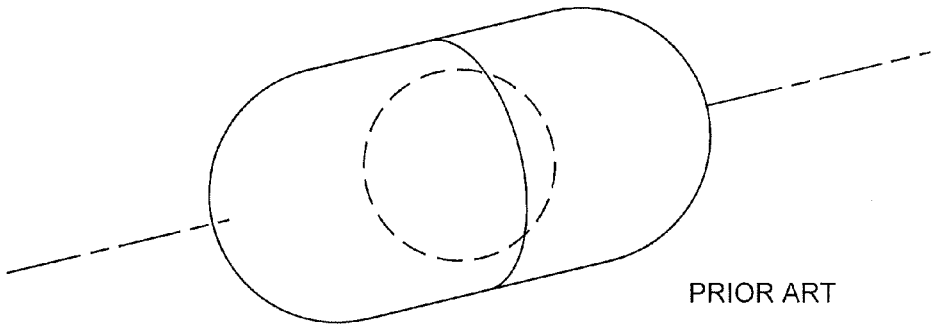
FIG. 1A shows a top perspective view of a typical prior-art tumbling toy.
Figure 1B:
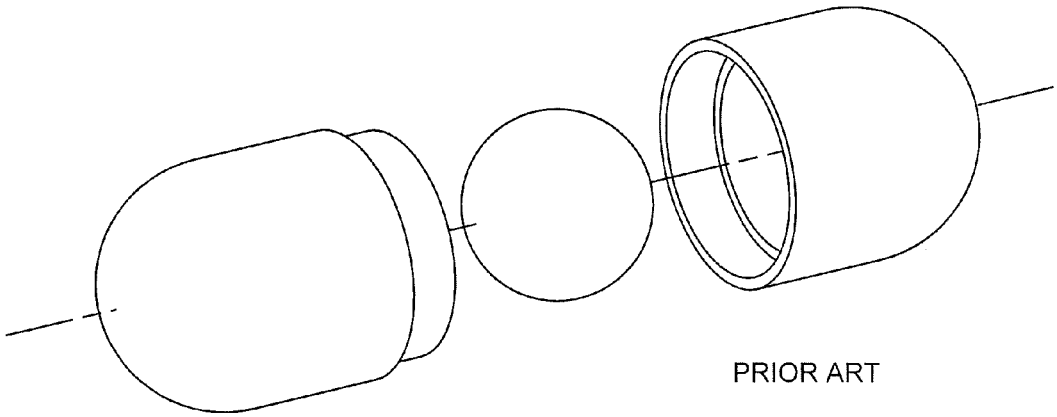
FIG. 1B shows an exploded view of the toy of FIG. 1A showing a rolling ball within a capsule.

FIGS. 1A and 1B show a prior-art tumbling toy to include a ball within a two-piece hollow capsule. The end portions are generally hemispherical and the longitudinal portion is generally cylindrical. It is desirable for the capsule to have considerably less mass than the ball. Typically, the capsule is plastic and the ball is metal, such as, steel. A rapidly changing center of gravity combined with the hemispherical ends, results in a whimsical or erratic behavior when handled. In addition, the tumbling toy is capable of tumbling downwardly end-over-end on a suitable incline. The end surface may have a small, substantially flat region such that the toy may be displayed on its end. Longitudinal portions may be barrel shaped. Importantly, this type of prior-art tumbling toy has an axisymmetric shape about the longitudinal axis, wherein the tumbling toy is free to roll about the longitudinal axis. Consequently, axisymmetric shapes of this construction are not well suited for sustained end-over-end tumbling without a track providing lateral support.

Figure 2:
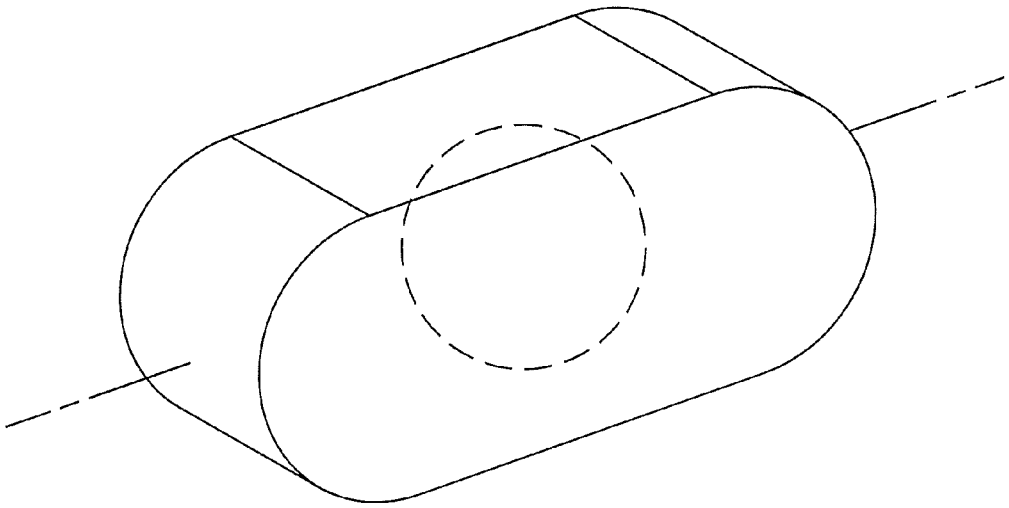
PRIOR ART FIG. 2
FIG. 2 shows a top perspective view of a second prior-art tumbling toy to include a hollow body and a rolling ball. The hollow body is an extruded oval shape with planar and cylindrical outer contact surfaces.

FIG. 2 shows a representation of another prior-art tumbling toy with oval sides. Unlike the prior-art tumbling toy shown in FIG. 1, the prior-art tumbling shown in FIG. 2 is not axisymmetric about a longitudinal axis. Therefore, the tumbling toy is not free to roll laterally. However, as a result of the flat and cylindrical outer contact surfaces this type of tumbling toy can only travel along a linear path.

Figure 3A:
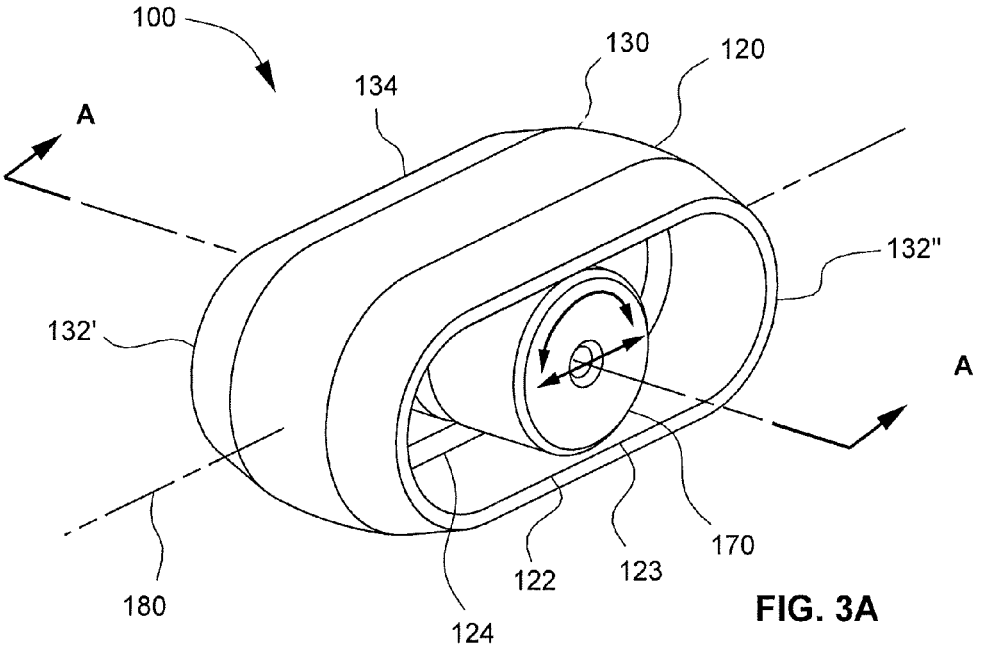
FIG. 3A is a top perspective view.
Figure 3B:
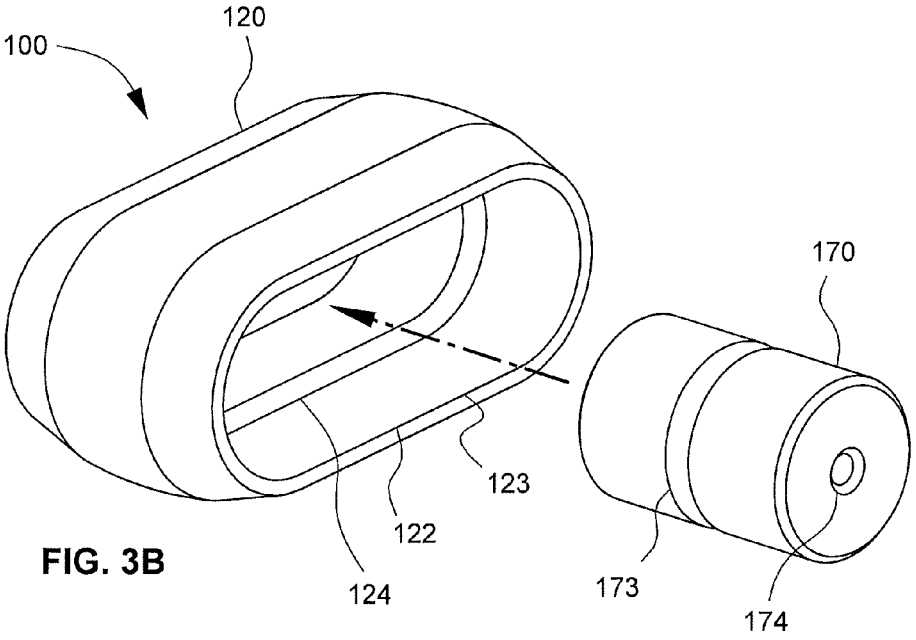
FIG. 3B is an exploded view.
Figure 3C:
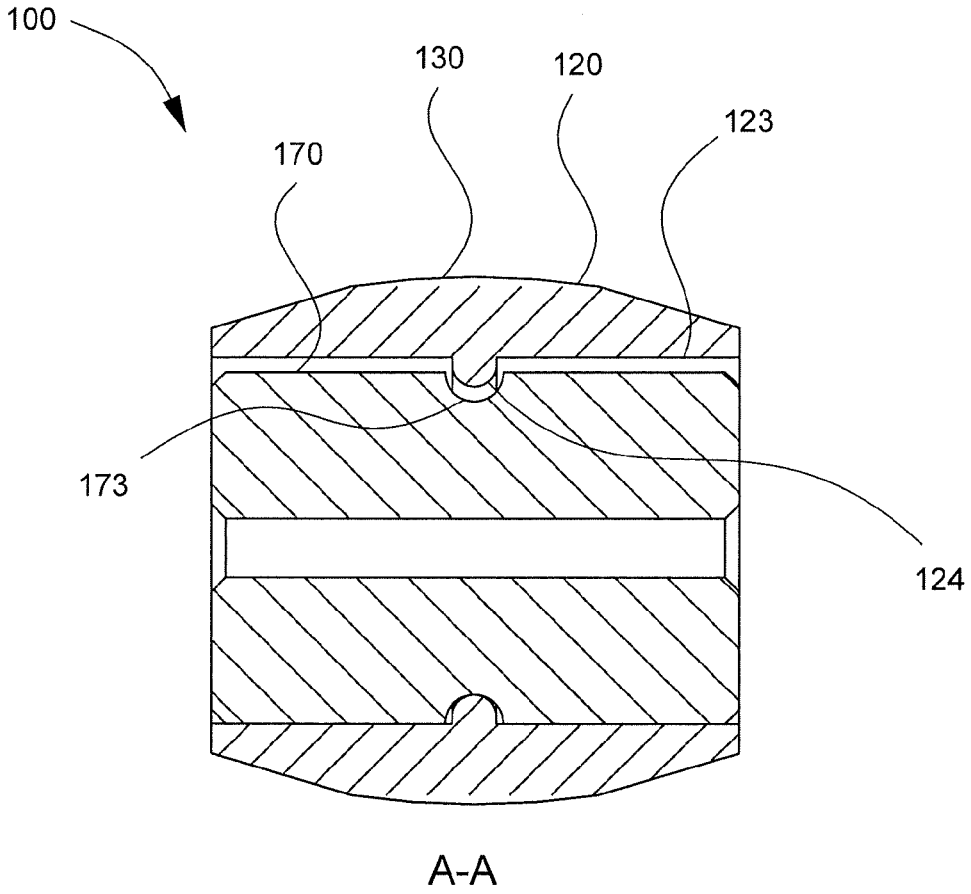
FIG. 3C is a cross-sectional view taken along the line A-A of FIG. 3A show a first preferred embodiment of a tumbling toy vehicle to include an elongated body and a rolling mass. The elongated body has non-axisymmetric shape, further characterized by a left to right camber of the outer contact surface. The shape of the vehicle enables a directional bias toward the instantaneous lowest point on a play surface.

FIGS. 3A, 3B, and 3C show an embodiment, tumbling toy vehicle 100, comprising an elongated body 120 and a rolling mass 170. Elongated body is comprised of end portions 132' and 132", longitudinal portion 134, lateral opening 122, longitudinal passage 123, and longitudinal guide 124. Longitudinal guide 124 and/or lateral openings 122 may not be provided with all embodiments. Elongated body 120 is preferably shaped to provide certain vehicle dynamics related to maneuverability and stability. Elongated body 120 has a non-axisymmetric shape, wherein the curvature of outer contact surface 130 may be partially characterized by an outward cambered shape from left to right. Rolling mass 170 may have cylindrical shape, circumferential guide 173, and an optional hole 174. Rolling mass 170 is preferably capable of rotation and longitudinal movement within longitudinal passage 123. Tumbling toy vehicle 100 is associated with longitudinal axis 180 defining a centerline. Referring now to FIG. 3B, elongated body 120, by providing lateral opening 122 for at least some embodiments, a degree of flexibility enables rolling mass 170 to relatively assist snap-fit within elongated body 120. The interlocking relation between elongated body 120 and rolling mass may further be shown in FIG. 3C depicting cross-section A-A of FIG. 3A, wherein longitudinal guide 124 may protrude from elongated body 120 and circumferential guide 173 may be a complimentary groove. The appropriate part clearances are established to allow rolling mass 170 the freedom to roll within elongated body 120. The functional shape and dynamic characteristics of tumbling toy vehicle 100 will be discussed in greater detail in subsequent sections.

It is desirable that tumbling toys preferably use a rolling mass that has a substantially greater mass than the elongated body. Suitable materials for the elongated body include injection molded plastics, such as, ABS and polycarbonate or other material(s). The elongated body may also be partially or wholly constructed of materials providing resistance to sliding on a play surface. These materials could include elastomers, rubbers, silicones, or TPRs. In comparison to the elongated body, it is often desirable to construct the rolling mass from materials having a greater density. Preferred materials for a rolling mass include metals, such as steel, but any number of materials may be used. At least a portion of rolling mass may be magnet to enable tumbling toy vehicle to magnetically adhere to steep metallic play surfaces, such as a refrigerator door.

Figure 4:
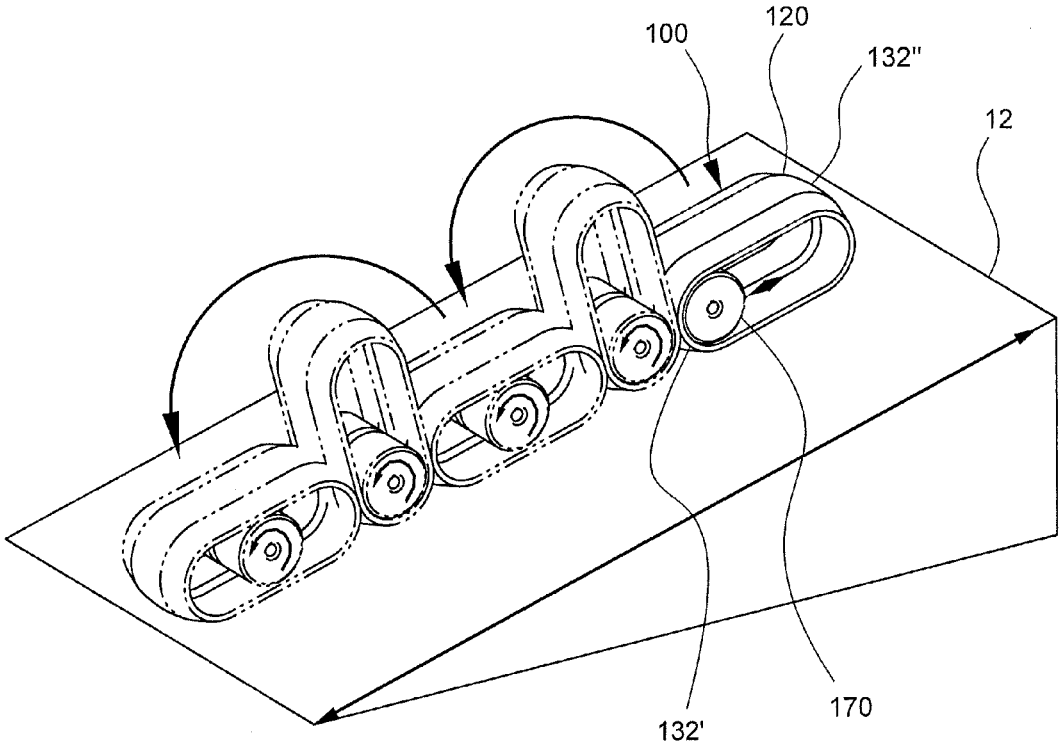
FIG. 4 is a top perspective view showing the embodiment of FIG. 3A on a simple incline to demonstrate basic tumbling motion.

Relating to the simplest form of operation, tumbling toy vehicle 100 (FIG. 3A) is shown in motion on incline 12 in FIG. 4. Given sufficient slope to incline 12, tumbling toy vehicle 100 rotates, flips, or tumbles end-over-end in the manner shown. It is evident that the speed of tumbling toy vehicle 100 is partially related to the degree of inclination. Considering the initial position shown in FIG. 4, the center-of-gravity of tumbling toy vehicle 100 is biased toward first end 132'. The forward position of the center-of-gravity, in combination with the arcuate shape of first end 132', results in a 180-degree rotation of tumbling toy vehicle 100 in descent. Rolling mass 170 then travels from first end 132' to second end 132", and the corresponding forward shift of the center-of-gravity causes another 180-degree rotation of tumbling toy vehicle 100 about second end 132". The pattern is repeated as tumbling toy vehicle 100 descends down incline 12.

Figure 5A:
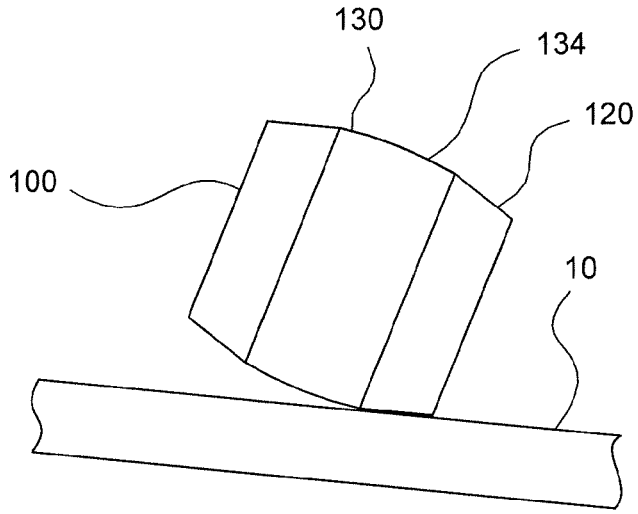
FIGS. 5A and 5B are front plan views showing the embodiment of FIG. 3A in rotated orientations on a play surface to include an incline with a lateral component.
Figure 5B:
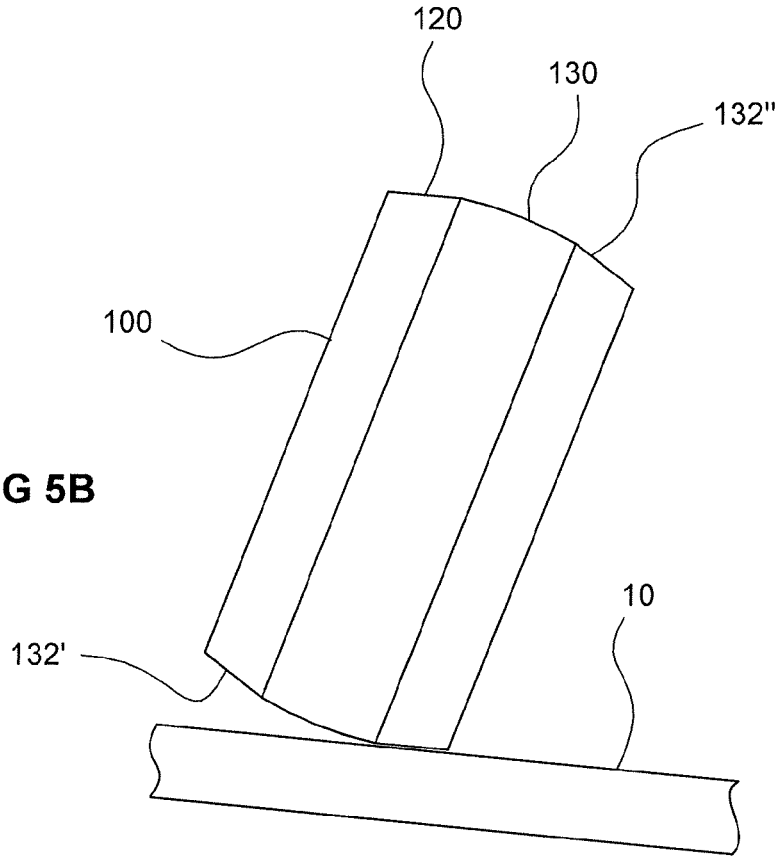

Certain prior-art tumbling toys have a substantially axisymmetric shape, such as, a capsule shape, and have a strong tendency to roll laterally with respect to the longitudinal axis if presented with an incline having at least a small lateral component (see prior-art tumbling toy in FIG. 1). The capsule shaped toy simply will not repeatedly roll end over end without a track to support the toy laterally. Certain other prior-art tumbling toys with a substantially rectangular transverse cross section do not respond to a small lateral incline (i.e., they continue a linear trajectory), but may eventually fall on a flat side when presented with sufficient lateral incline (see prior-art tumbling toy in FIG. 2). In contrast, tumbling toy vehicle 100 (FIG. 3A) is intended to respond and adapt to an incline lateral to the instantaneous direction of tumbling toy vehicle 100. Since outer contact surface 130 is outwardly cambered from left to right, tumbling toy vehicle 100 can achieve certain orientations in response to an incline with a lateral component. For example, FIG. 5A shows an end view of tumbling toy vehicle 100 rotated with respect to play surface 10. However, the degree of camber of outer contact surface 130 does not allow tumbling toy vehicle 100 to roll freely in response to an incline with a lateral component. Similarly, FIG. 5B shows another rotated orientation wherein first end 132' is in contact with play surface 10. Further detail regarding motion of the toy vehicle 100 will be discussed below.

Figure 6:
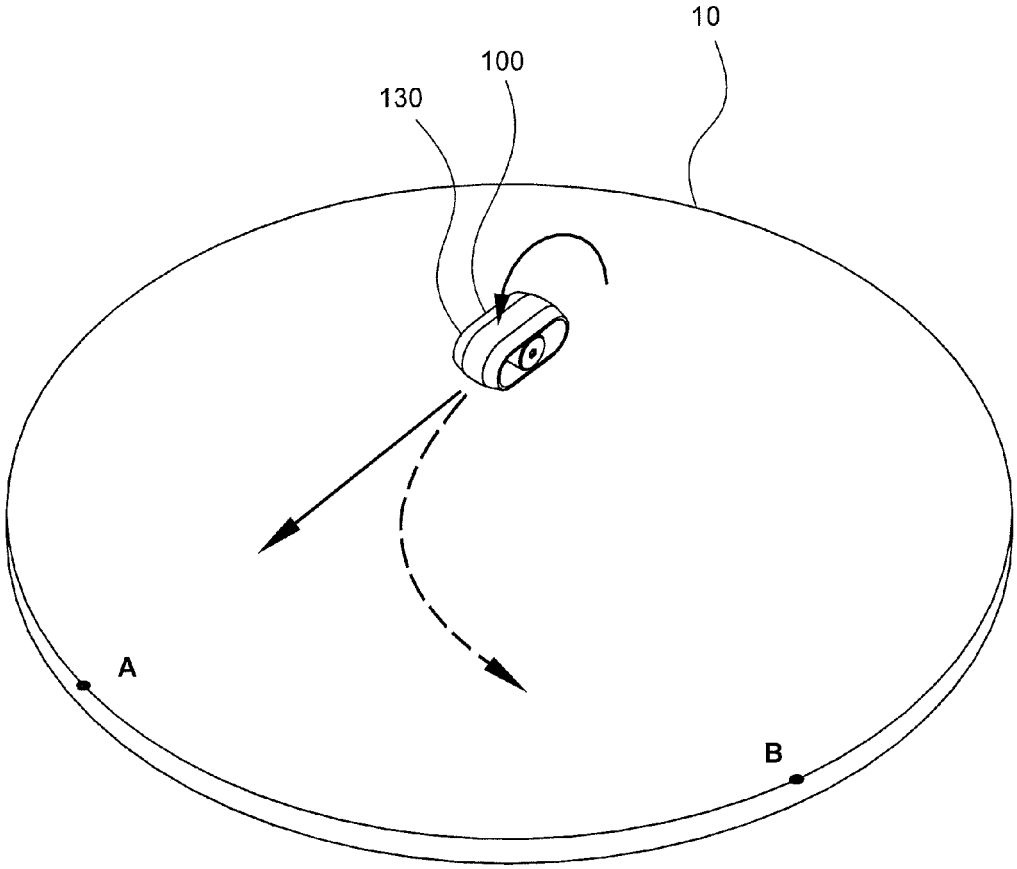
FIG. 6 is a top perspective view showing the embodiment of FIG. 3A on a user controllable play surface to demonstrate the directional bias toward the instantaneous lowest point on a play surface.

Tumbling toy vehicle 100 is intended for interactive play, wherein a play surface can be manipulated by the user to control speed and direction. Now considering FIG. 6, tumbling toy vehicle 100 of FIG. 3A is shown on play surface 10. Play surface 10 is suitably sized to be held and tilted by hand such as a notebook (whether stiff or not) or other surface. Consider point A on play surface 10 as the instantaneous lowest point on play surface 10 with tumbling toy vehicle 100 initially tumbling in the direction indicated by the solid arrow. Should the user manipulate play surface 10 such that point B is now the instantaneous lowest point on play surface 10, tumbling toy vehicle 100 will normally change direction toward point B, as indicated by the dashed arrow. This does not occur with the prior art designs of FIG. 1 or FIG. 2. More specifically, FIG. 1 design would have a strong tendency to roll laterally, rather than travel end-over-end, and FIG. 2 design would continue linearly or fall over on its side. Since outer contact surface 130 is preferably outwardly cambered from left to right, tumbling toy vehicle 100 may have a directional bias toward the instantaneous lowest point on a play surface. As the user tilts play surface 10 in various positions, the user can effectively control the speed and direction of tumbling toy vehicle 100 for many embodiments. Outer contact surface 130 can provide variable surface camber from medial (less curvature) to lateral (greater curvature), such that small lateral banking of play surface 10 results in gentle turning and larger (or quicker) lateral banking of play surface 10 results in tighter turns. Tumbling toy vehicle 100 can also be responsive to the angular acceleration of play surface 10 during interactive play. As an example of interactive play, the user may operate tumbling toy vehicle 100 in a circle or through an obstacle course which is also not possible with the prior art toys of FIGS. 1 and 2.

Figure 7:
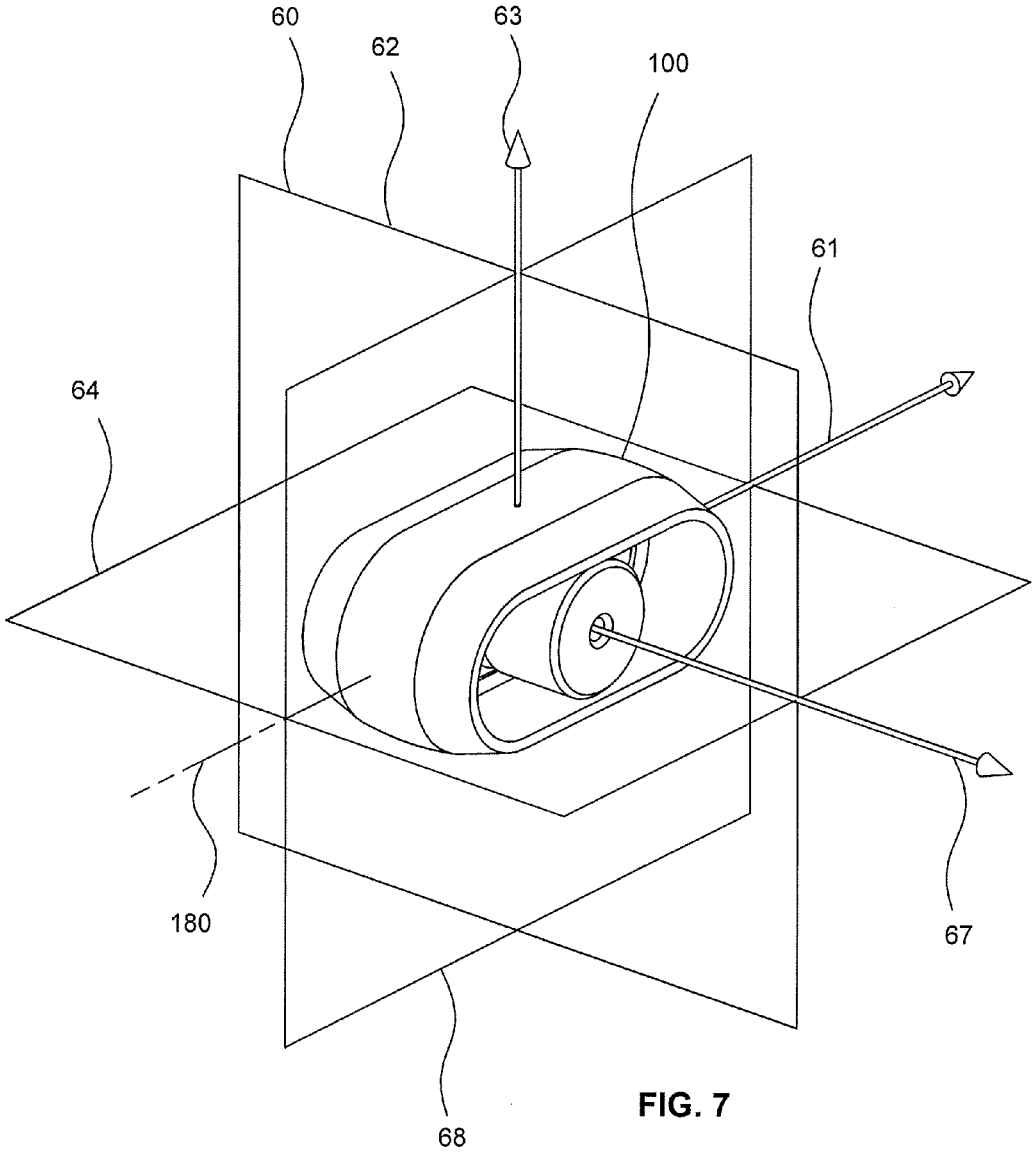
FIG. 7 is a top perspective view showing the embodiment of FIG. 3A associated with a local coordinate system for defining motion and direction.

Coordinate systems and terms associated with aircraft dynamics are useful in describing the dynamics of a tumbling toy vehicle. Referring now to FIG. 7, local coordinate system 60 is associated with tumbling toy vehicle 100 first shown in FIG. 3A. Local coordinate system 60 includes a roll axis 61, yaw axis 63, and pitch axis 67. Longitudinal axis 180 is aligned with roll axis 61. Centrally located planes of coordinate system 60 include transverse plane 62, longitudinal plane 64, and medial plane 68, wherein medial plane 68 delineates left and right sides. Consistent with convention, local coordinate system 60 is fixed relative to the tumbling toy vehicle.

Figure 9:
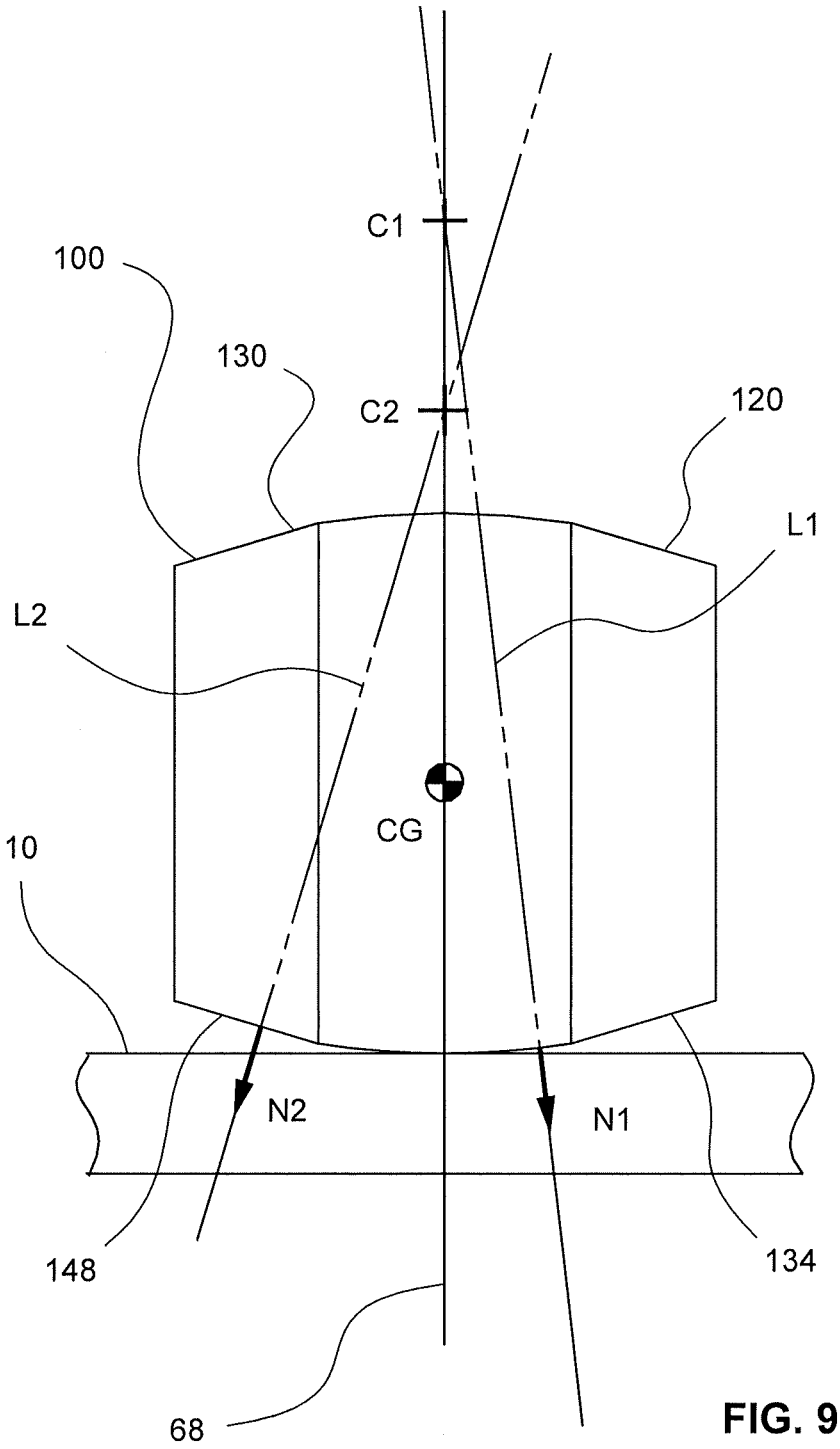
FIG. 9 is a front plan view showing an end view of the embodiment of FIG. 3A for consideration of surface camber in relationship with the center-of-gravity.
Figure 10:
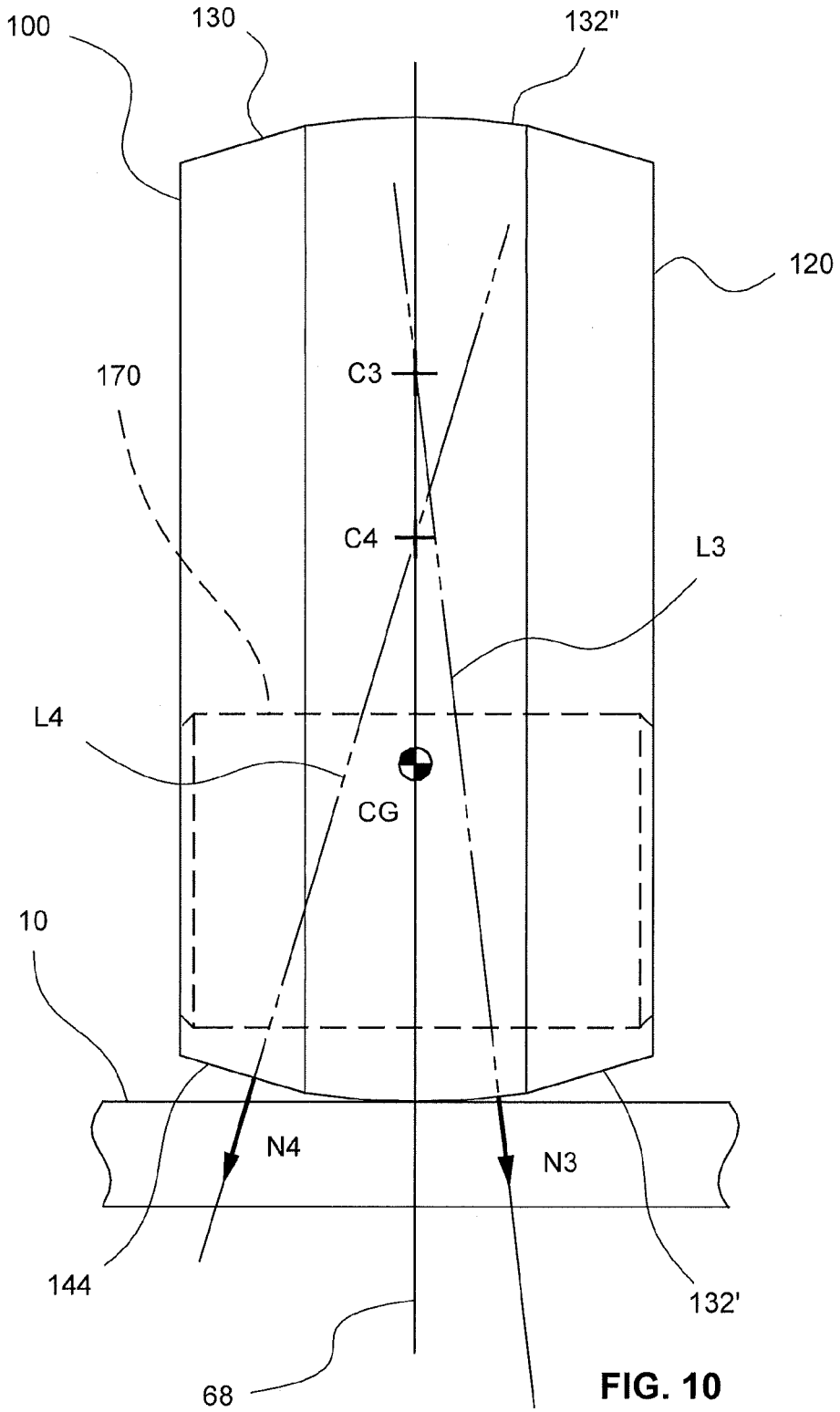
FIG. 10 is a front plan view showing the embodiment of FIG. 3A in a view with an end portion in contact with a representative play surface.

A left to right camber is understood to an arc, whether made of curved segments and/or planar segments, such as faceted or otherwise, of less than 180 degrees and preferably substantially less than 180 degrees as described in further detail below with reference to FIGS. 9 and 10.

Figure 8:
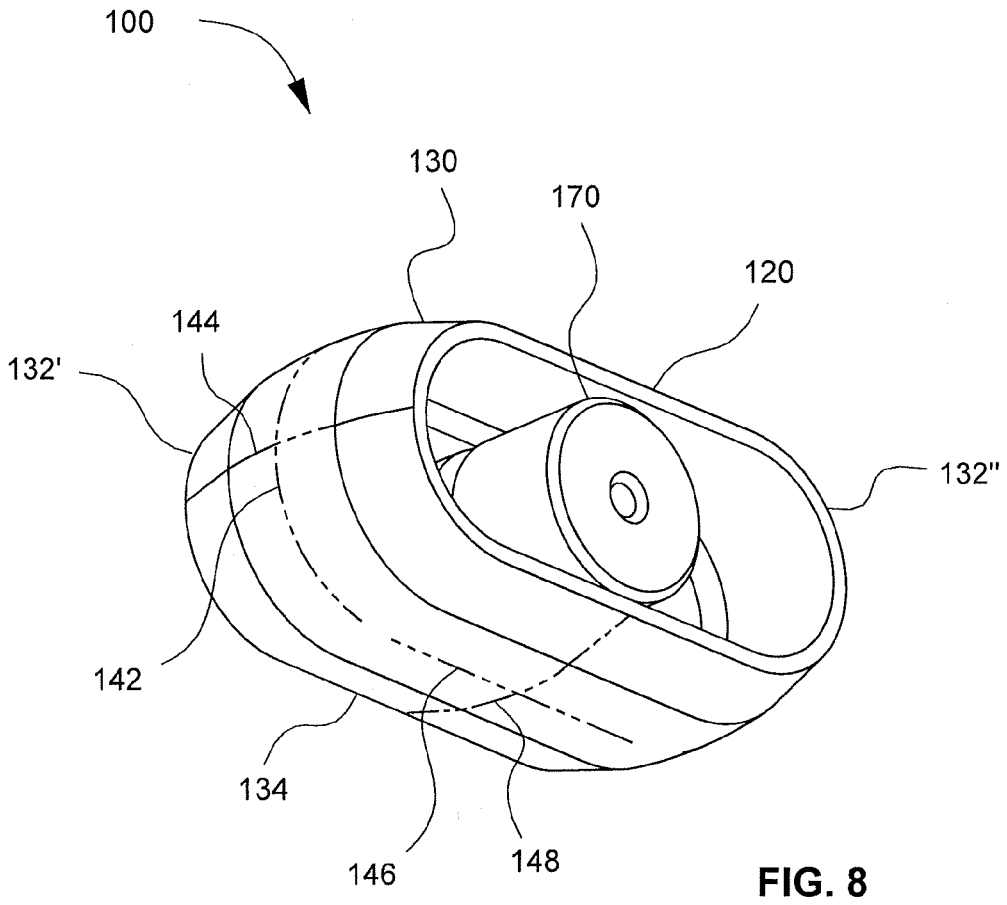
FIG. 8 is a bottom perspective view showing the embodiment of FIG. 3A associated with contour lines used to define the functional outer shape of the elongated body.

Contour lines can be used to define the outer boundary and functional shape of a tumbling toy vehicle. Unless otherwise noted, contour lines may not follow local recessed portions. FIG. 8 shows tumbling toy vehicle 100 of FIG. 3A in association with contour lines used to describe the shape of outer contact surface 130. Longitudinal contour line 146 and transverse contour line 148 and are associated with longitudinal portion 134. Longitudinal contour line 146 is within the medial plane and transverse contour line 148 is orthogonal to longitudinal contour line 146. Longitudinal contour line 146 is a straight line, though it may also be arcuate. Transverse contour line 148 is outwardly cambered from left to right to enable rotation with respect to longitudinal axis 180 (roll axis). Pitch contour line 142 and lateral contour line 144 are associated with first end portion 132'. Pitch contour line 142 is within the medial plane and lateral contour line 144 is orthogonal to pitch contour line 142. Like transverse contour line 148, lateral contour line 144 is outwardly cambered from left to right. Pitch contour line 142 is associated with surface curvature enabling tumbling toy vehicle to pitch, or tumble end-over-end. Pitch contour line 142 has substantially greater curvature than lateral contour line 144. Pitch contour line 142 and lateral contour line 144 define a convex portion of outer contact surface 130 in association with first end portion 132'. This convexity enables directional change of tumbling toy vehicle 100 as a response to a lateral inclination of a play surface. Lateral contour line 144 has substantially less curvature compared to pitch contour line 142, such that directional change can occur in a moderate and controlled manner. A preferred shape for pitch contour line 142 is a circular arc spanning 180-degrees. In contrast, a preferred shape of the lateral contour line 144 is a cambered curve following an arc spanning substantially less than 180-degrees.

Tumbling toy vehicle 100 dynamic characteristics, to include stability and maneuverability, are largely dependent on outer surface geometry in relation to the instantaneous center-of-gravity. Referring now to FIG. 9, an end view of tumbling toy vehicle 100 of FIG. 3A is shown on a representative play surface 10. Normals N1 and N2 are associated with transverse contour line 148 (also see FIG. 8 showing transverse contour line 148). Normals N1 and N2 also represent surface normals associated with outer contact surface 130. Colinear with normal N1 and N2, are first normal line L1 and second normal line L2, respectively. As a result of the cambered shape of transverse contour line 148, the first normal line L1 and second normal line L2 intersect the medial plane at a substantial distance above the center-of-gravity CG, as represented by intersection point C1 and intersection point C2, respectively. Further, intersection points C1 and C2 are above elongated body 120. Since intersection point C1 is also associated with a curved portion of transverse contour line 148, it is also a center of curvature. In general, the greater the distance an intersection point or center of curvature is above the center-of-gravity, the greater the stability, wherein the potential for maneuverability is less. Since intersection point C1 and intersection point C2 are not coincident, outer contact surface 130 has variable surface camber from medial (less curvature) to lateral (greater curvature).

Directional control of tumbling toy vehicle 100, and certain other embodiments, is substantially a result of the shape of the end portions. Referring now to FIG. 10, tumbling toy vehicle 100 of FIG. 3A is shown in a position with first end 132' in contact with play surface 10. Rolling mass 170 is proximal to play surface 10 and a typical center-of-gravity CG of tumbling toy vehicle 100 is located above play surface 10, as shown in FIG. 10. The arcuate shape of contour line 144 (also see FIG. 8 showing contour line 144) is further defined by normal N3 and normal N4. Consistent with previous discussion, normal N3 and normal N4 are associated with a third normal line L3 and a fourth normal line L4, respectively. Third normal line L3 and fourth normal line L4 intersect medial plane 68 substantially above center-of-gravity CG, as represented by intersection points C3 and C4, respectively. C3 is also a center of curvature. Again, the greater the distance an intersection point or center of curvature is above the center-of-gravity, the greater the vehicle stability, wherein the potential for maneuverability is less. Since point C3 and point C4 are not coincident, outer contact surface 130 has variable surface camber from medial (less curvature) to lateral (greater curvature).

Figure 11:
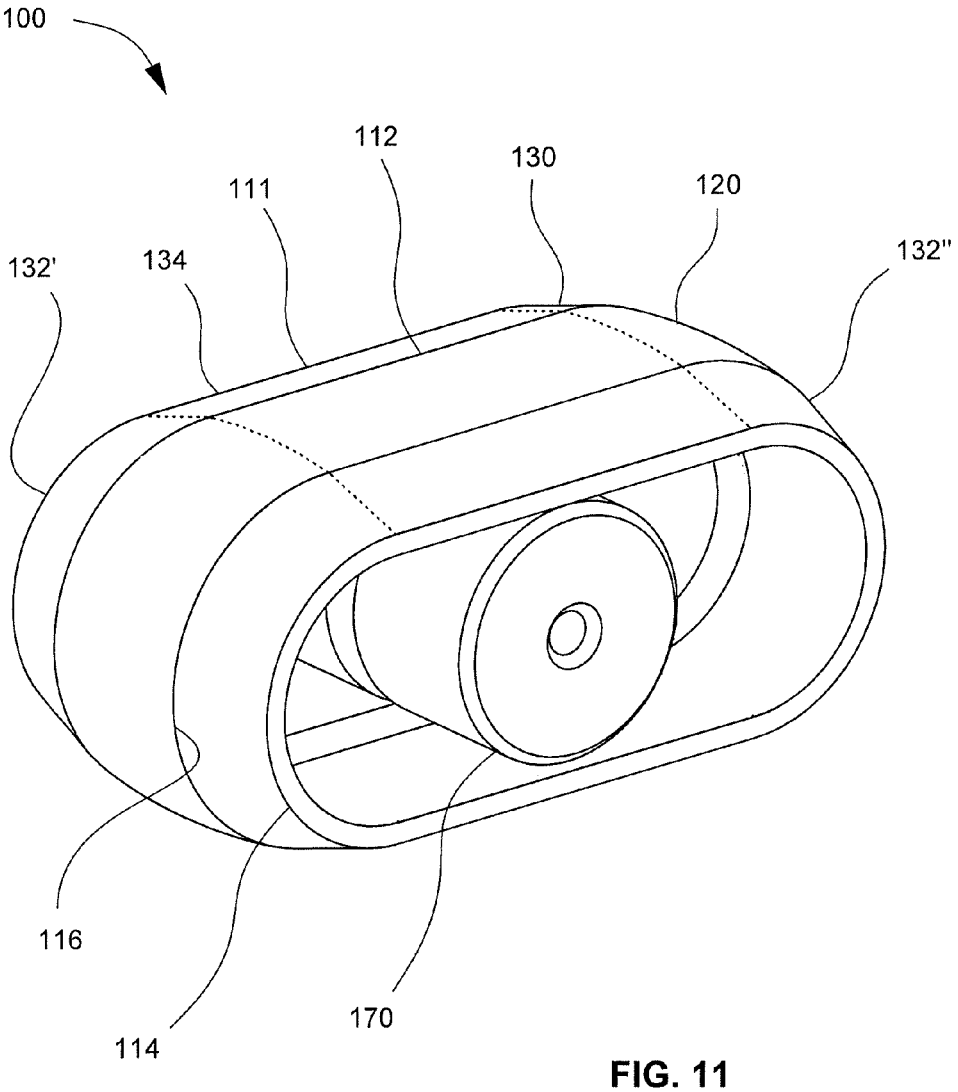
FIG. 11 is a side perspective view showing the embodiment of FIG. 3A, further defining the outer surface as an arrangement of surfaces portions. The surface portions are identified by surface type (e.g., cylindrical).

An outer contact surface can be a compilation of distinctly shaped surface portions, constructed to form the desired shape of a tumbling toy vehicle. As an example, outer contact surface 130 of tumbling toy vehicle 100 (FIG. 3A) is comprised of surface portions with well known surface geometry. As shown in FIG. 11, outer contact surface 130 includes the following exemplary surface portions: planar surface 111 and cylindrical surface 112 associated with first longitudinal portion 134, and conical surface 114 and toroidal surface 116 associated with end portion 132'. These surface portions, due to curvature or arrangement, provide tumbling toy vehicle 100 with a means for a variety of advantageous orientations on a play surface, enabling a directional bias toward the instantaneous lowest point on a play surface. As an example, conical surface 114, when the instantaneous contact surface portion, establishes a turning radius. A conical surface with greater curvature is associated with the ability to make tighter turns, though greater curvature also provides less stability. In contrast, the surface portions proximal to the medial plane are associated with the least curvature from left to right (cylindrical surface 112 and toroidal surface 116) providing greater vehicle stability when these surface portions are the instantaneous contact surface portion.

In summary of the present discussion relating to tumbling toy vehicle 100, outer contact surface 130 is cambered from left to right (i.e., centerline outward) to provide stability and maneuverability. The degree of camber is preferably not constant, as outer contact surface 130 has variable surface camber from medial (less curvature) to lateral (greater curvature), thus providing intuitive maneuverability, wherein small lateral banking of the play surface results in gentle turning and larger (or quicker) lateral banking of the play surface results in smaller turning radii.

Figure 12:
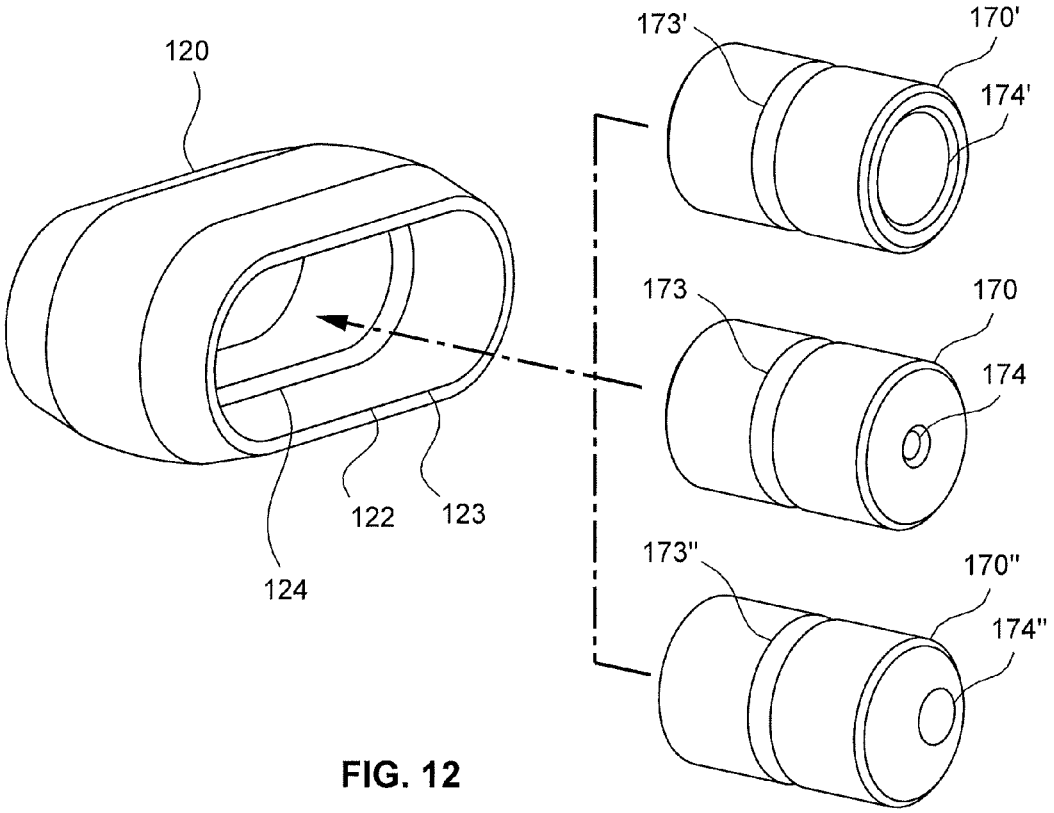
FIG. 12 is an exploded view showing the embodiment of FIG. 3A adaptable to a variety of rolling masses.

Tumbling toy vehicles can be advantageously configured with interchangeable components to provide users with the ability to explore the vehicle dynamics of different configurations. As an example, elongated body 120 (FIG. 3A) is shown in FIG. 12 with a variety of rolling masses, to include aforementioned rolling mass 170, along with rolling masses 170' and 170". Respectively, the present rolling masses are configured with like-dimensioned grooves serving as circumferential guides 173, 173', and 173". Elongated body 120 includes lateral opening 122 and longitudinal guide 124. Rolling masses 170, 170', and 170" may be utilized as reversible interlocking snap-fit with elongated body 120, wherein the connection is provided with clearances to allow relative movement between the two components. Since the diameter of thru hole 174' of rolling mass 170' may be considerably greater than the diameter of thru hole 174 of rolling mass 170, rolling mass 170' may have less mass when compared to rolling mass 170. Rolling mass 170" may include eccentric thru hole 174", resulting in a more erratic tumbling behavior due to the eccentricity. The availability of different rolling mass options provides a means for exploring various vehicle dynamics. Similarly, a rolling mass can be configured to fit within a variety of elongated bodies.

Figure 13A:
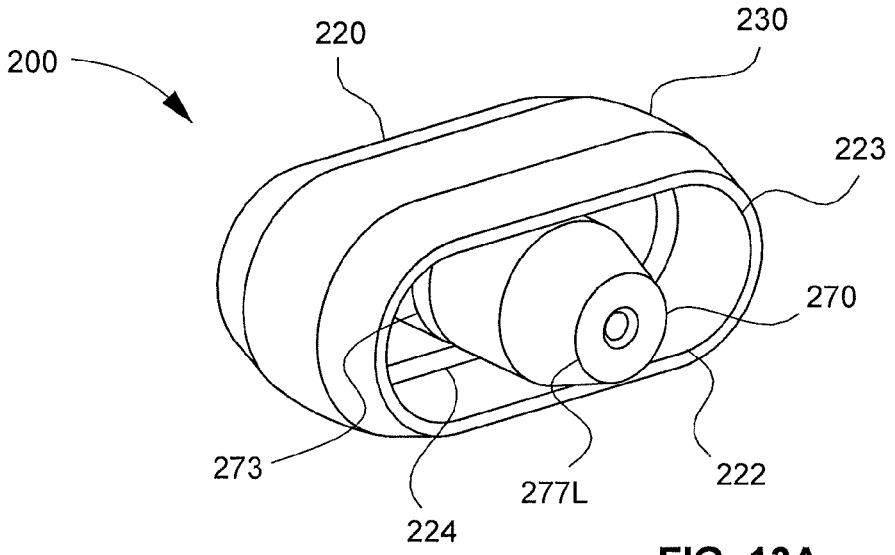
FIGS. 13A and 13B are a top perspective and an exploded views respectively showing a second preferred embodiment with a rolling mass extending laterally from an elongated body.
Figure 13B:
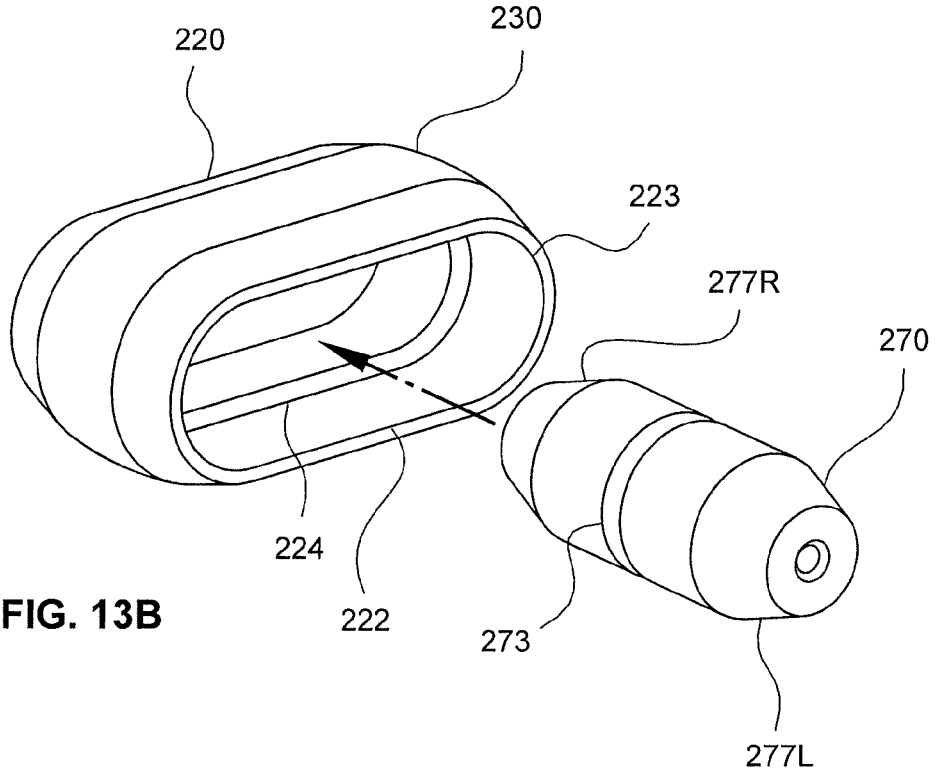

Since it is advantageous for a rolling mass to have significantly greater mass than the elongated body, a rolling mass may advantageously extend beyond the boundary of the elongated body. Referring now to FIGS. 13A and 13B, another embodiment is represented by tumbling toy vehicle 200 to include elongated body 220 and rolling mass 270. Elongated body 220 may have, outer contact surface 230, longitudinal passage 223 and longitudinal guide 224 to interlock with circumferential guide 273 of rolling mass 270. Longitudinal guide 224 is a protrusion and circumferential guide 273 is a groove to enable elongated body 220 and rolling mass 270 to engage in a locking manner (snap-fit). Appropriate part clearances allow rolling mass 270 to freely travel longitudinally with respect to elongated body 220. Rolling mass 270 may have extended end portions 277R and 277L. Although the extended end portions 277R and 277L are shown as truncated cones, other shapes are possible.

Figure 14:
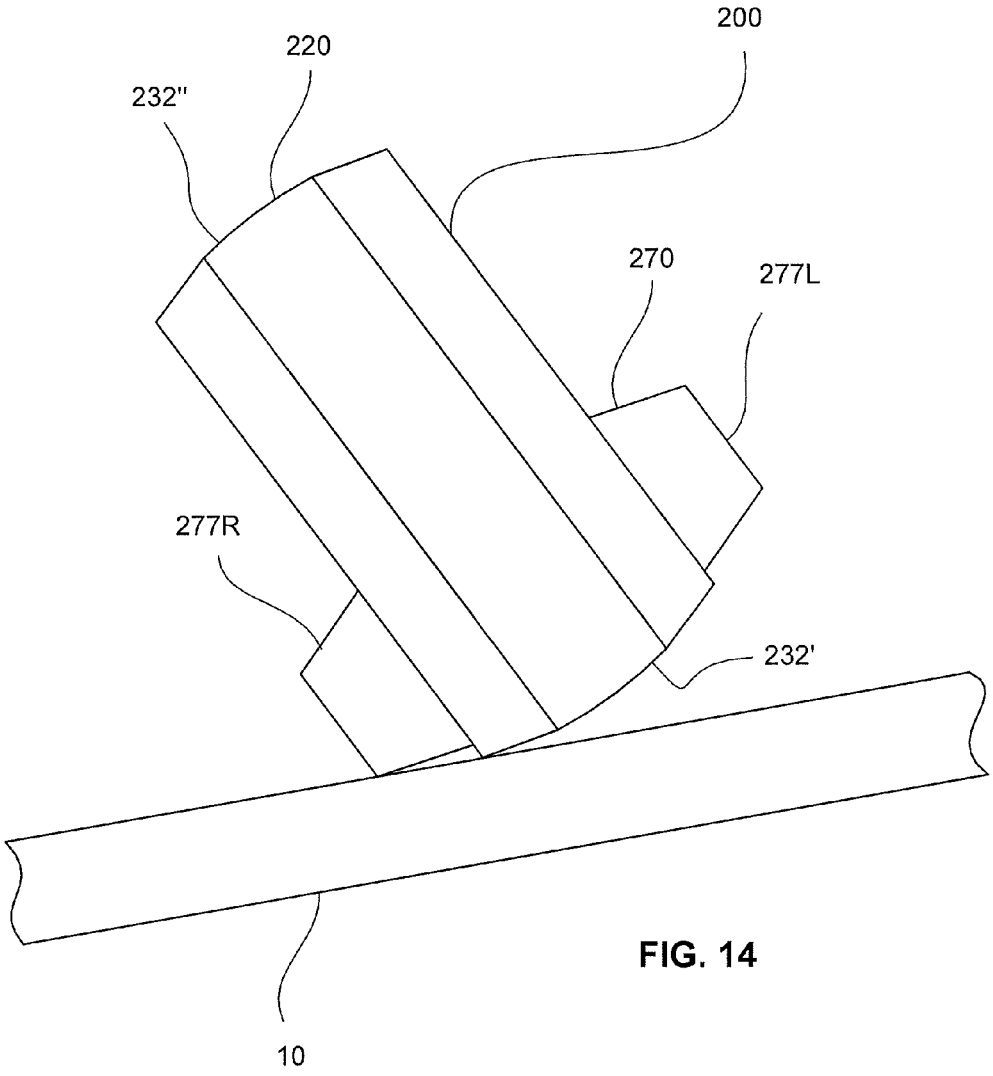
FIG. 14 is a front plan view showing the embodiment of FIG. 13A wherein the rolling mass is in contact with a play surface during a turn.

A tumbling toy vehicle can be advantageously configured with a rolling mass that provides stability and directional control thru possible direct contact with a play surface. In other embodiments, it may be unlikely for extended end portions 277R or 277L to contact a play surface. Referring now to FIG. 14, tumbling toy vehicle 200 of FIG. 13 is shown to include first end 232' in contact with play surface 10, wherein play surface 10 has an incline with at least a lateral component. In the orientation shown, extended end portion 277R, as a truncated cone shape, provides limits to rotation with respect to yaw and facilitates a controlled right turn.

Figure 15A:
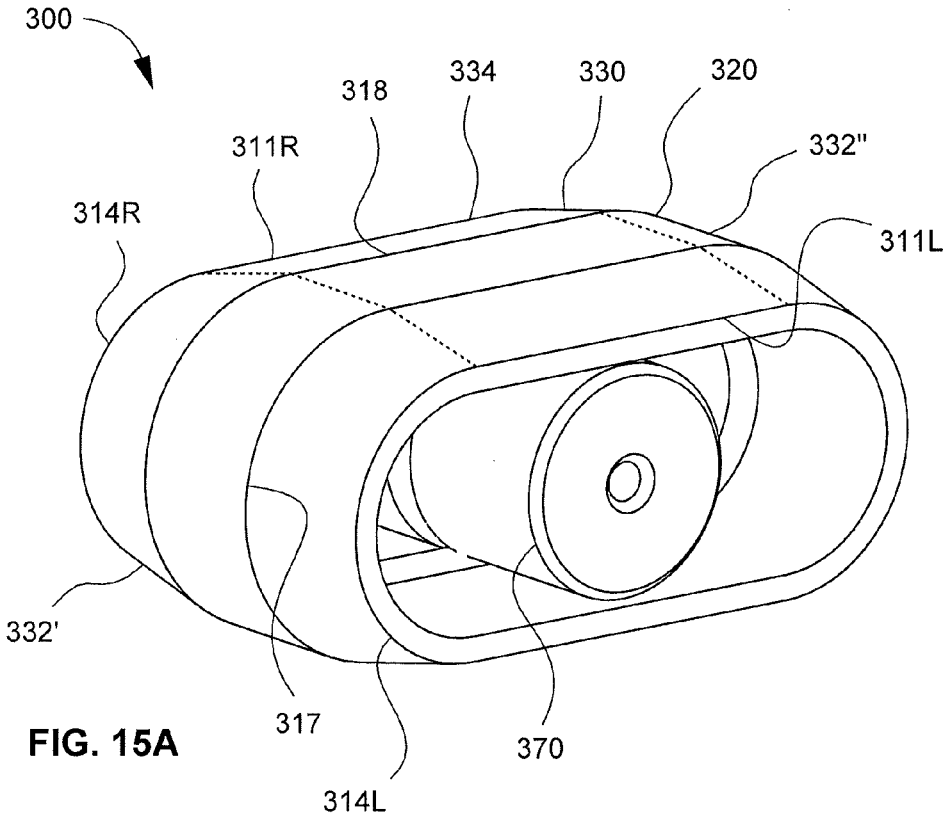
FIGS. 15A and 15B are a top perspective and front plan views showing a third preferred embodiment of a tumbling toy vehicle having a width substantially greater than the height, a geometric relation to provide stability. This embodiment also demonstrates how surface curvature can be created by an arcuate arrangement of planar surface portions.
Figure 15B:
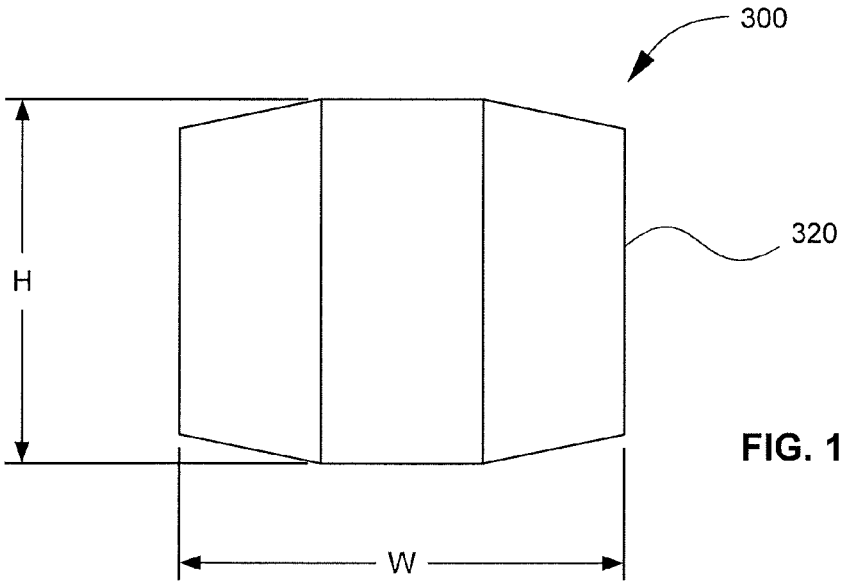

To provide greater vehicle stability, especially with respect to roll and yaw, a tumbling toy vehicle may be advantageously configured with a relatively large width in comparison to other primary vehicle dimensions. Accordingly, FIGS. 15A and 15B disclose another embodiment, tumbling toy vehicle 300, with a width W greater than height H. Specifically, tumbling toy vehicle 300 is comprised of elongated body 320 and rolling mass 370. The outer contact surface 330 has surface portions arranged in an arcuate manner to provide stability and maneuverability. Specifically, end portion 332' of elongated body 320 includes conical surfaces 314R and 314L adjacent to central cylindrical surface 317. Outer surface portions associated with longitudinal portion 334, to include central planar surface 318, lateral planar surface 311L, and lateral portion 311R, demonstrate how an arcuate shape can be created in a faceted manner using only planar surfaces. Conical surfaces 314R and 314L, when an instantaneous contact surface, enable tumbling toy vehicle 300 to establish a turning radius on a play surface.

A tumbling toy vehicle can be designed to tumble along an at least substantially straight path despite the presence of an incline with a relatively small lateral angle component, yet turn in response to a relatively large lateral incline. Referring again to tumbling toy vehicle 300 (FIGS. 15A and 15B), the arrangement of the medial surface portions of outer contact surface 330 include central planar surface 318 and central cylindrical surface 317. These medial surface portions enable tumbling toy vehicle 300 to track along a straight path in the presence of a relatively small lateral angle of a play surface. An incline with a large lateral component relative to tumbling vehicle 300 or rapid tilting of a play surface can tip tumbling toy vehicle 300, wherein the lateral surface portions become the instantaneous contact surface portions (i.e., conical surfaces 314R and 314L, or lateral planar surfaces 311R and 311L) to enable a change in direction.

Figure 16:
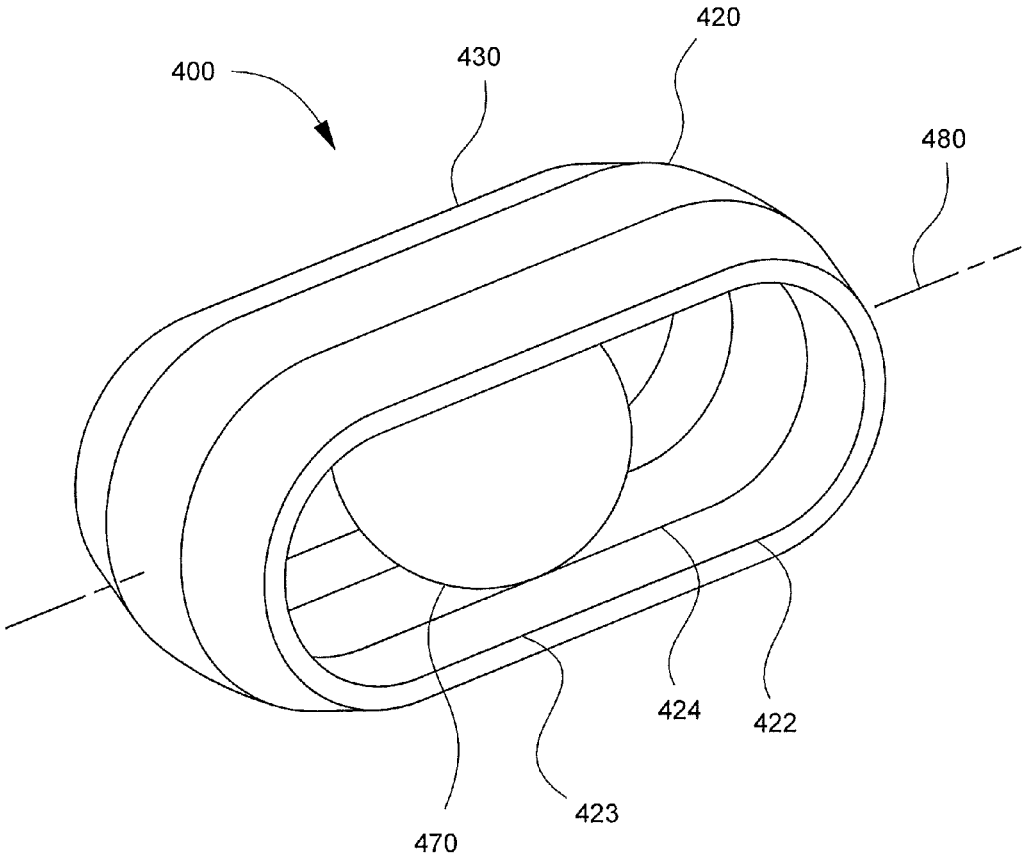
FIG. 16 is a top perspective view showing a fourth preferred embodiment of the present invention with a spherical rolling mass and a non-axisymmetric elongated body, wherein the outer contact surface is cambered from left to right.

FIG. 16 shows another embodiment, tumbling toy vehicle 400, to include an elongated body 420 and rolling mass 470. Elongated body 420 has a non-axisymmetric shape wherein outer contact surface 430 is outwardly cambered from left to right to provide stability and a directional bias toward the instantaneous lowest point on a play surface. Elongated body 420 is associated with longitudinal axis 480 and includes lateral opening 422, longitudinal passage 423, and longitudinal guide 424. Rolling mass 470 has a spherical shape. Longitudinal guide 424 may be a groove sized to receive rolling mass 470 in an interlocking manner with appropriate clearance to allow rolling mass 470 to freely roll longitudinally within longitudinal passage 423. Tracks or other structure could also be utilized to retain rolling mass 470 serving as a longitudinal guide.

Figure 17:
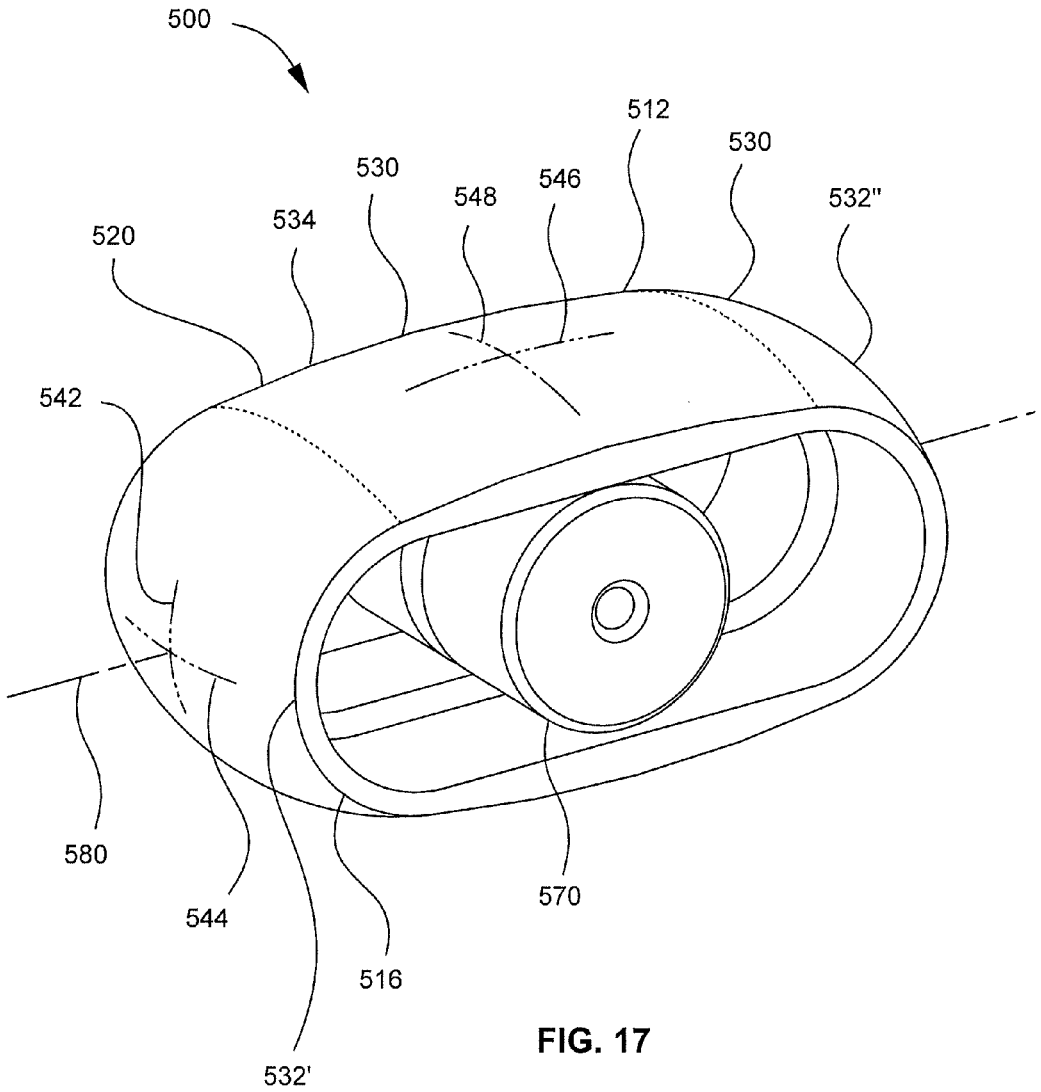
FIG. 17 is a top perspective view of a fifth preferred embodiment wherein the outer contact surface is entirely convex, further characterized by a left to right camber and a non-axisymmetric shape.

A tumbling toy vehicle can be advantageously configured with an entirely convex outer contact surface. Referring now to FIG. 17, tumbling toy vehicle 500 is comprised of elongated body 520 and rolling mass 570. Elongated body 520 is illustrated as a non-axisymmetric shape, wherein outer contact surface 530 is cambered from left to right. Elongated body 520 includes first end portion 532', second end portion 532", and longitudinal portion 534. Outer contact surface 530 is comprised of several surface portions, to include longitudinal convex surface portion 512 associated with longitudinal portion 534 and end convex surface portion 516 associated with first end portion 532'. Longitudinal convex surface portion 512 is convex, cambered in two directions as indicated by longitudinal contour line 546 and transverse contour line 548. End convex surface portion 516 is shaped to enable tumbling toy vehicle 500 to readily tumble end-over-end end, while providing a significant degree of stability in roll and yaw. Accordingly, second end contour line 542 has substantially greater curvature than first end contour line 544. Since outer contact surface 530 is entirely convex, it is possible for tumbling toy vehicle 500 to be continually engaged in turning throughout tumbling rotations. Continuing to refer to FIG. 17, a preferred shape for second end contour line 542 generally follows a circular arc spanning 180-degrees, wherein preferred shapes for first end contour 544, longitudinal contour line 546, and transverse contour line 548 generally follows an arc spanning substantially less than 180-degrees such as less than about 135 degrees, about or less than about 90 degrees, about or less than about 60 degrees. The presently discussed contour lines may also be defined by polynomials with a constant or variable curvature.

Figure 18:
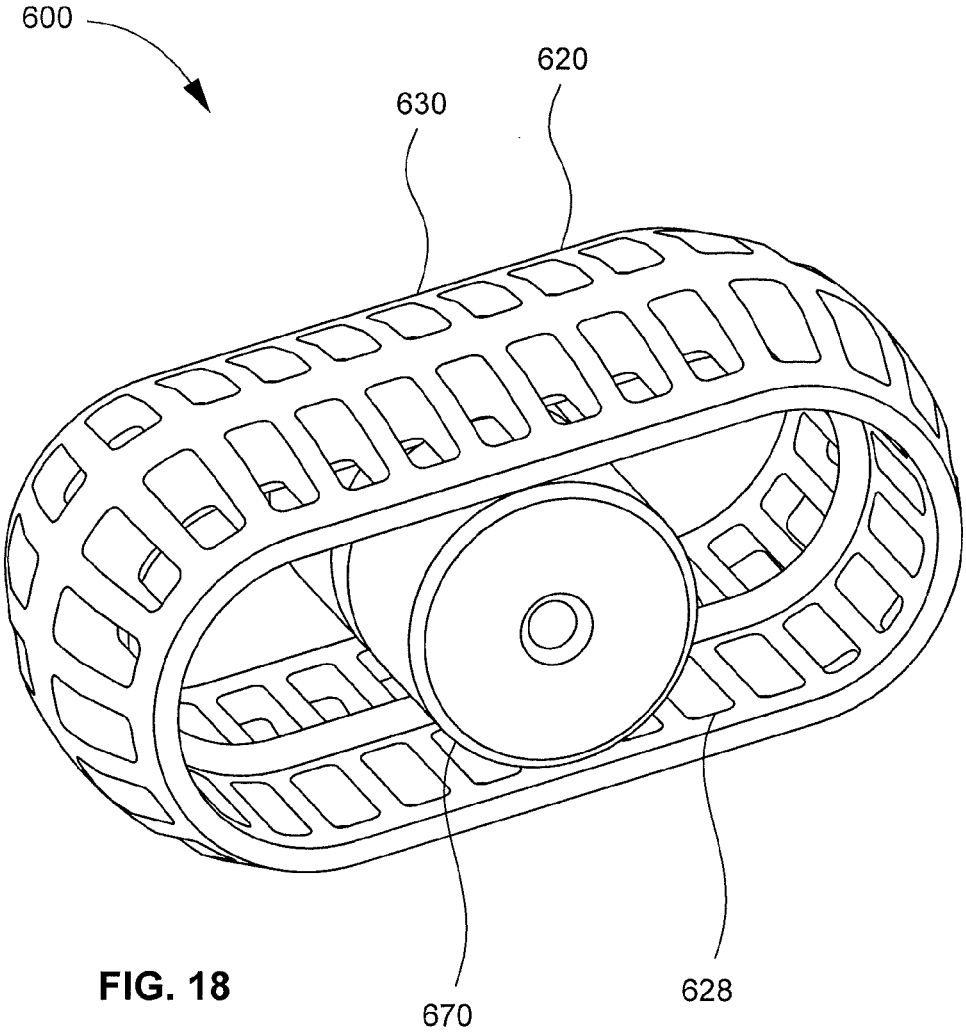
FIG. 18 is a top perspective view showing a sixth preferred embodiment of a tumbling toy vehicle to include an elongated body and a rolling mass, wherein the elongated body is adapted with rectangular holes to reduce the mass of the elongated body, while maintaining an overall outer shape.

As stated previously, it is desirable that tumbling toys use a rolling mass that has a substantially greater mass relative to the mass of the elongated body. The body of a tumbling toy vehicle is advantageously adaptable to cutouts, holes, dimples, recesses, slots to provide for reduced mass while maintaining a desired overall shape. The form of these features can be arranged in both a functional and aesthetic manner. As an example, FIG. 18 shows another embodiment, tumbling toy vehicle 600, to include elongated body 620 and rolling mass 670. Similar to previously disclosed embodiments, elongated body is non-axisymmetric and outer contact surface is 630 is outwardly arcuate or cambered from left to right. Cutout 628, shown as a rectangular thru-hole feature of elongated body 620 can be repetitive and/or different along the elongated body 620. These features can resemble earth moving equipment, tracks or other designs.

Figure 19A:
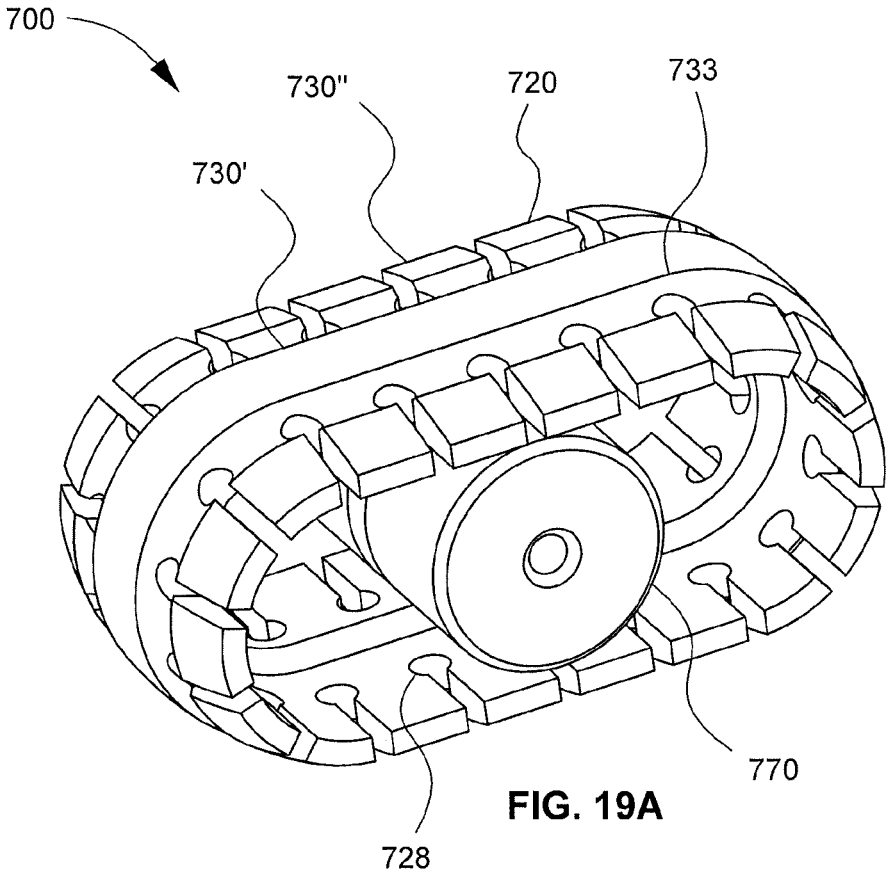
FIGS. 19A and 19B are top perspective and front plan views showing a seventh preferred embodiment of a tumbling toy vehicle with a non-axisymmetric shape, arcuate from left to right, wherein recessed portions and holes create an arrangement of separate outer contact surfaces.
Figure 19B:
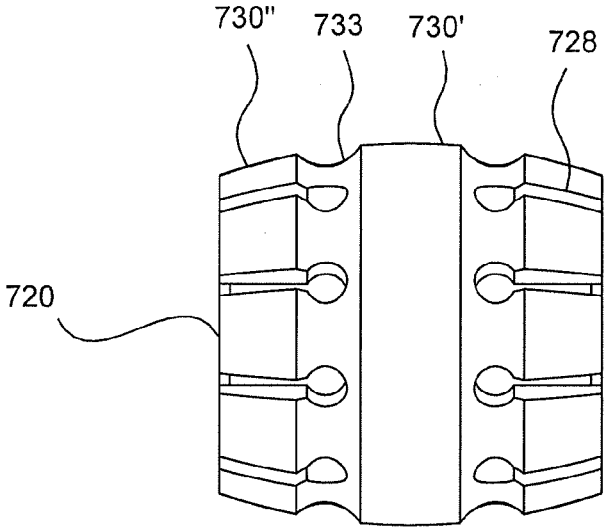

Multiple outer contact surfaces may be an arranged to form a desired outwardly arcuate, non-axisymmetric body shape. As an example, FIGS. 19A and 19B show embodiment 700, comprised of elongated body 720 and rolling mass 770. Elongated body 720 features central outer contact surface 730' and lateral outer contact surface 730". Cutout 728 and lateral groove 733 form the surface boundaries and provide for a lighter elongated body 720. Elongated body 720 may be outwardly cambered or arcuate from left to right to provide a directional bias toward the instantaneous lowest point on a play surface.

Figure 20:
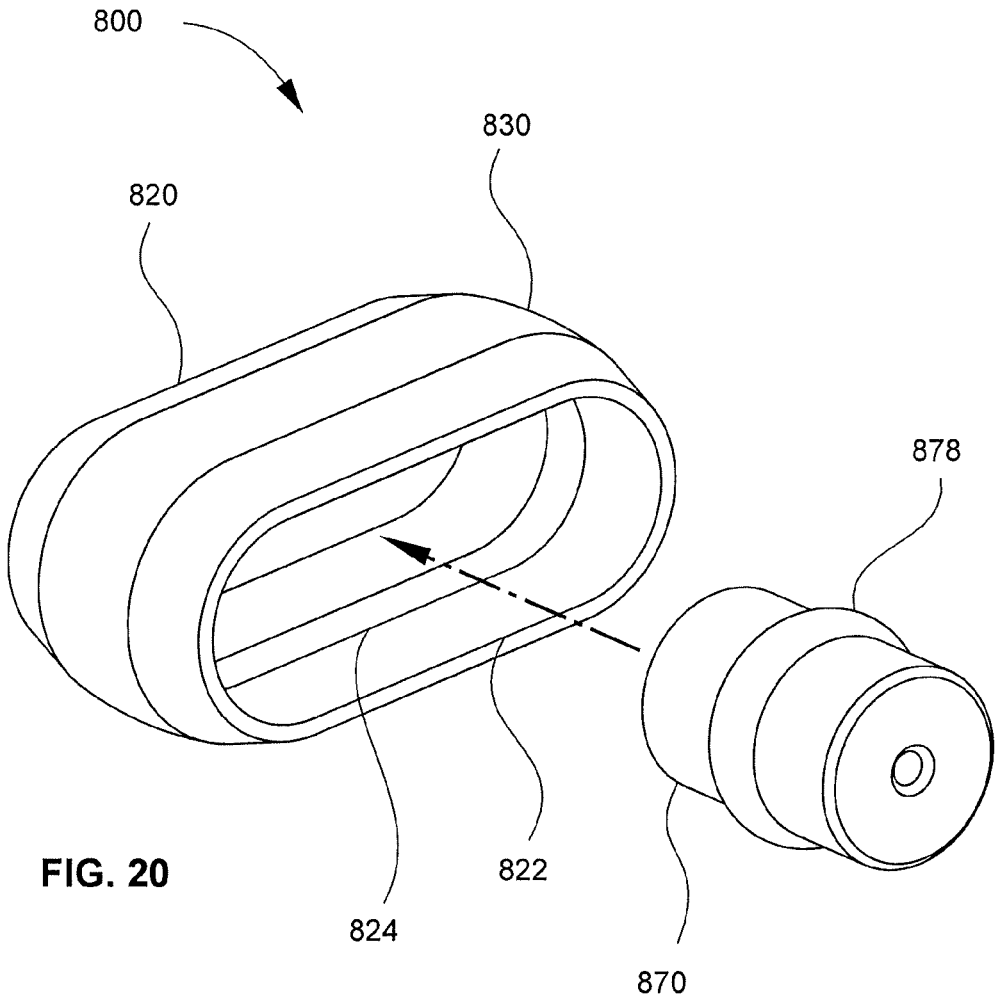
FIG. 20 is an exploded view showing an eighth preferred embodiment of a tumbling toy vehicle. This embodiment has an alternate means of connecting a rolling mass with an elongated body.

Various advantageous means may be used to connect the elongated body with the rolling mass. FIG. 20 shows another embodiment, tumbling toy vehicle 800 comprised of elongated body 820 and rolling mass 870. Elongated body 820 has a longitudinal guide 824 and lateral opening 822 to engage circumferential guide 878 of rolling mass 870 in an interlocking manner with the appropriate clearances to allow for relative longitudinal movement. Longitudinal guide 824 may be a groove, wherein circumferential guide 878 may be an annular protrusion. Elongated body 820 is non-axisymmetric and outer contact surface 830 is outwardly cambered left to right to provide a directional bias toward the lowest point on a play surface.

Figure 21:
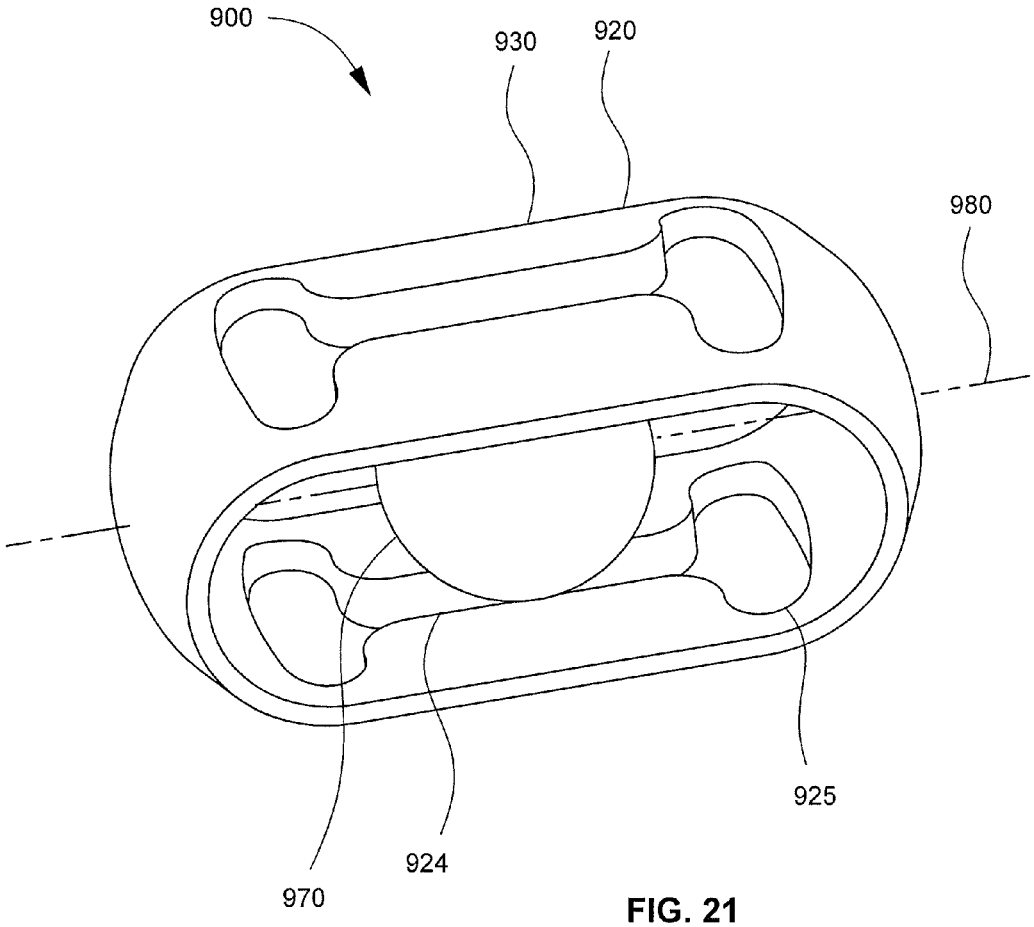
FIG. 21 is a top perspective view showing a ninth preferred embodiment of a tumbling toy vehicle with an elongated body and a rolling mass, wherein the rolling mass is provided with a means to shift laterally within the elongated body.

A tumbling toy vehicle can be provided with a means for the rolling mass to move laterally as well as longitudinally with respect to the elongated body. A potential lateral shift of the center-of-gravity changes vehicle dynamics, especially as it relates to enhancing turning. As an example, tumbling toy vehicle 900 is show in FIG. 21, to include elongated body 920 and rolling mass 970. Outer contact surface 930 is effectively arcuate with a left to right camber, enabling a directional control in response to a play surface incline with a lateral component. Elongated body 920 is adapted with longitudinal guide 924 and lateral guide 925. Lateral guide 925 provides a means for rolling mass 970 to translate laterally with respect to elongated body 920 such that the center-of-gravity of tumbling toy vehicle 900 may not always be coincident with longitudinal axis 980.

Figure 22:
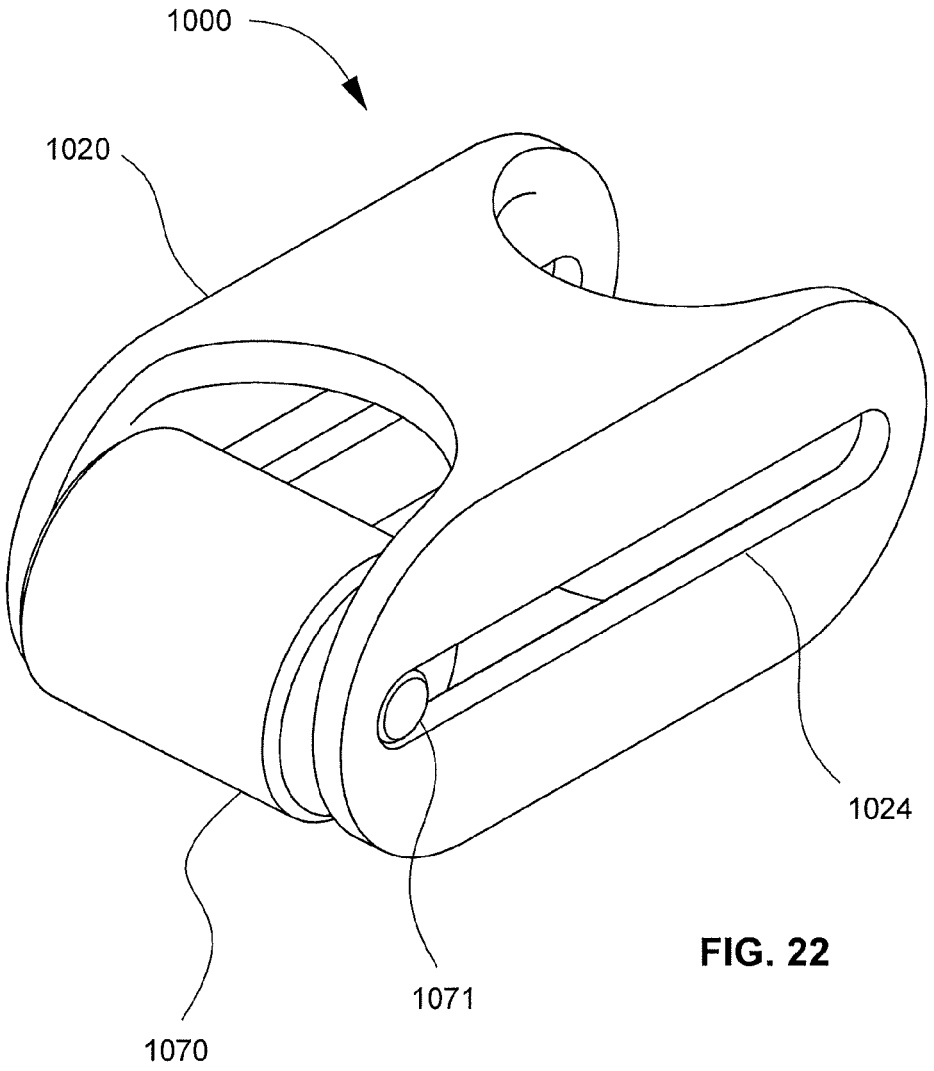
FIG. 22 is a front perspective view showing a tenth preferred embodiment of a tumbling toy vehicle with an elongated body and a rolling mass, wherein the rolling mass is provided with a means to extend forward of an elongated body.

The further forward the rolling mass, the greater the tendency for a tumbling toy vehicle to tumble end-over-end. Referring now to FIG. 22, tumbling toy vehicle 1000 is shown with an elongated body 1020 and rolling mass 1070. Rolling mass 1070, to include axle 1071, is constrained to longitudinal movement by longitudinal guide 1024 of elongated body 1020. Longitudinal guide 1024 is configured as a slot. As shown in the FIG. 22, rolling mass 1070 can extend forward of elongated body 1020 to provide an advantageous pitch of tumbling toy vehicle 1000 in an end-over-end manner. Rolling mass 1070 is configured to make contact with a play surface through the elongated body 1020. Rolling mass 1070 is shown as a cylindrical shape, though other shapes, such as, a barrel shape or even an at least partially entrapped sphere can be used to facilitate turning.

Figure 23:
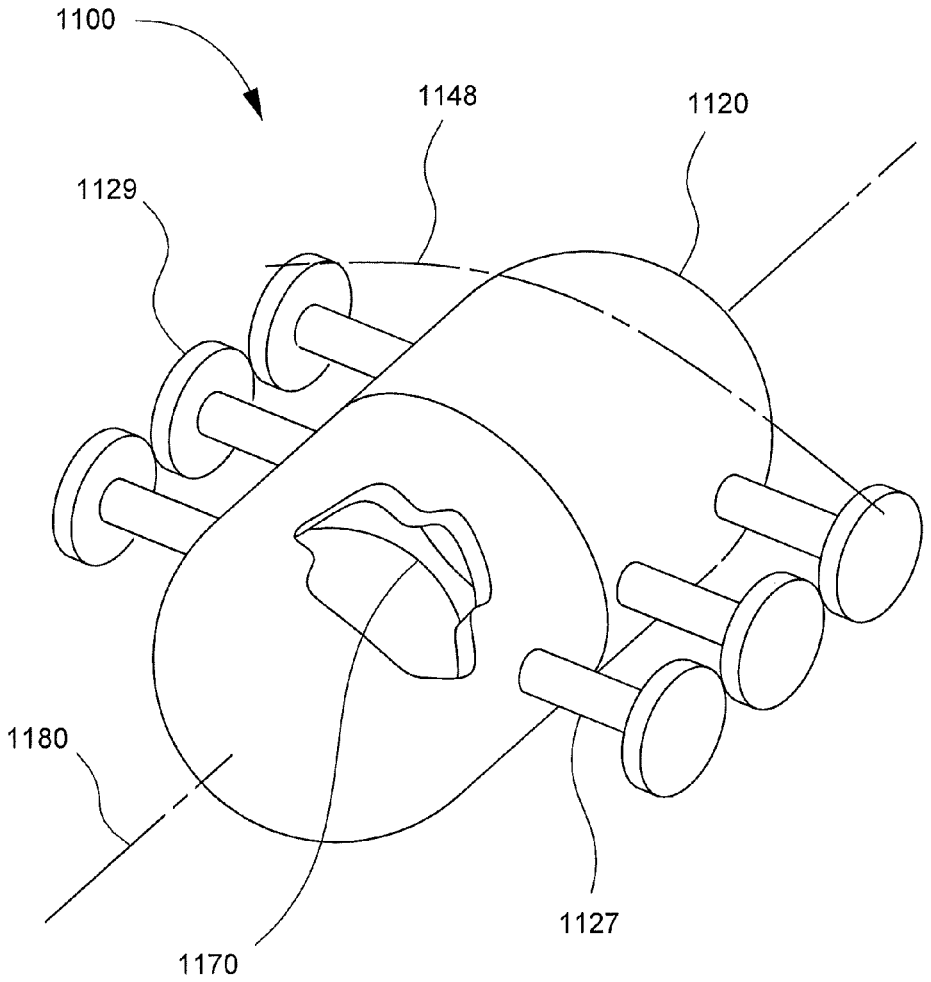
FIG. 23 is a front perspective view showing an eleventh preferred embodiment of a tumbling toy vehicle styled as a bug with extended surface contact regions for limiting roll about the longitudinal axis.

Appendages may also be used to arrange contact surfaces or edges in an arcuate manner. As an example, a tumbling toy vehicle can be styled as a bug or other design, wherein the bug's "legs" and "feet" provide stability and directional control. Another embodiment, tumbling toy vehicle 1100, shown in FIG. 23, includes elongated body 1120 as a two part hollow capsule, appendages 1127 (legs), and exemplary lateral contact surface 1129 (feet). Rolling mass 1170 is a sphere. Contour lines can be used to describe a functional outline of separate contact surfaces arranged in specific manner to produce a desired shape. Accordingly, contour line 1148 is used to show the arcuate arrangement of surfaces with respect to longitudinal axis 1180 enabling tumbling toy vehicle 1100 to have limited roll with respect to longitudinal axis 1180.

Figure 24A:
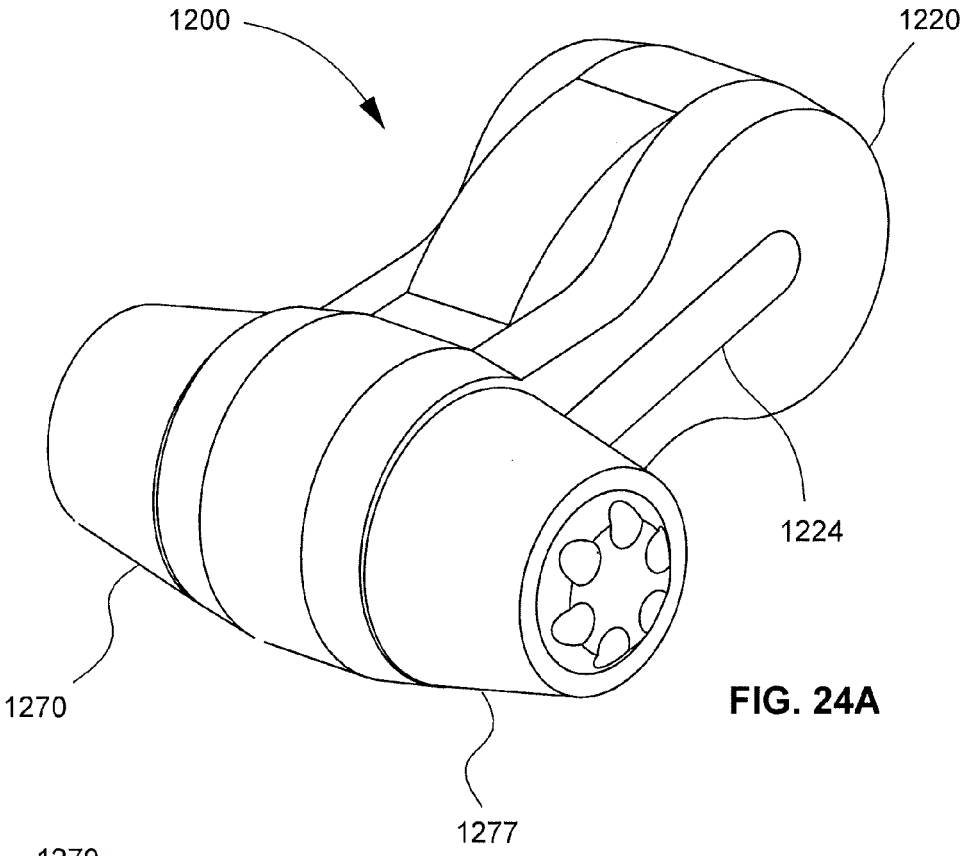
FIGS. 24A and 24B are top perspective views showing a twelfth preferred embodiment of a tumbling toy vehicle styled as a race car and the rolling mass removed therefrom.
Figure 24B:
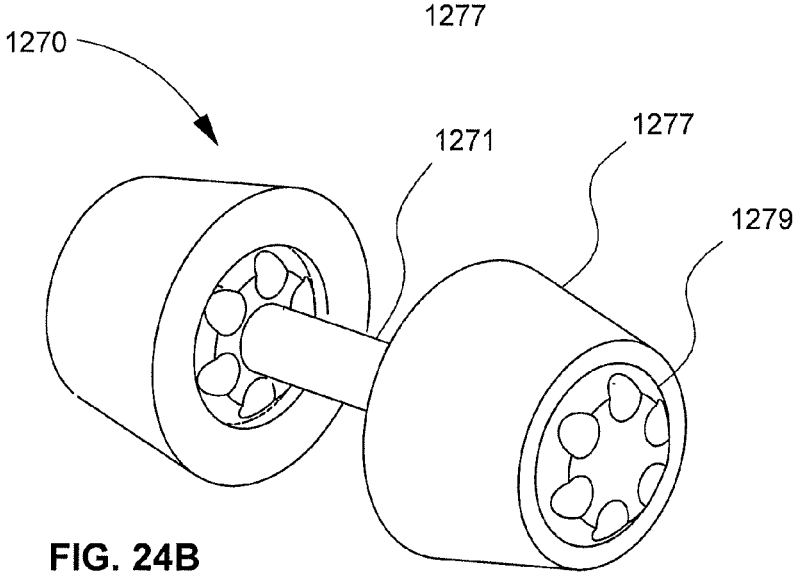

FIG. 24A shows another embodiment styled as a race car. Specifically, tumbling toy vehicle 1200 includes elongated body 1220 and rolling mass assembly 1270. As shown in FIG. 24B, rolling mass 1270 is comprised of axle 1271, hub 1279, and tire 1277. Rolling mass 1270 moves within longitudinal guide 1224 which is a slot passing thru elongated body 1220. Similar to tumbling toy vehicle 200 (FIG. 13A), tire 1277 has a conical outer surface adapted to make contact with a play surface to enhance turning. Elongated body 1220 is outwardly arcuate from left to right to provide adaptive orientation based on play surface dynamics, to include a bias to travel toward the lowest point on a play surface.

Figure 25:
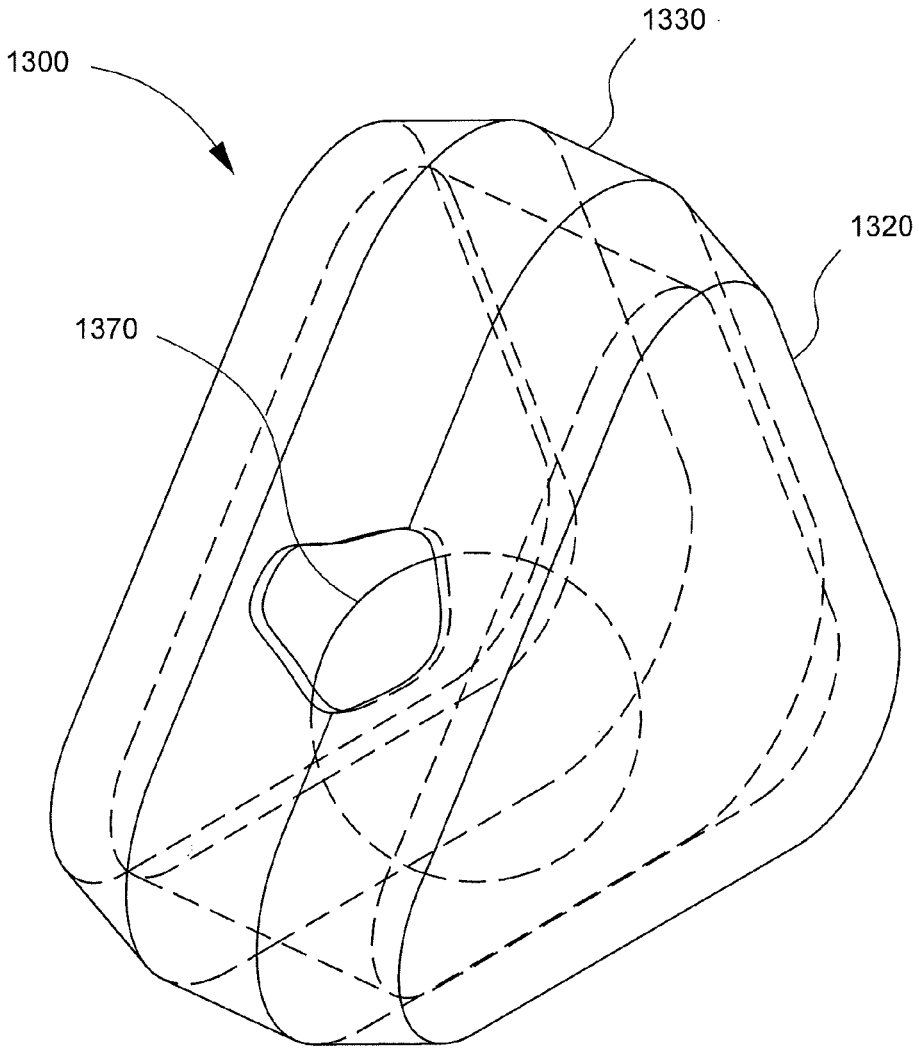
FIG. 25 is a front perspective view showing a thirteenth embodiment of a tumbling toy vehicle to include a triangular shaped body and a spherical rolling mass. Outer contact surfaces may preferably be suitably arcuate to provide a directional bias toward the instantaneous lowest point on a play surface.
Figure 26:
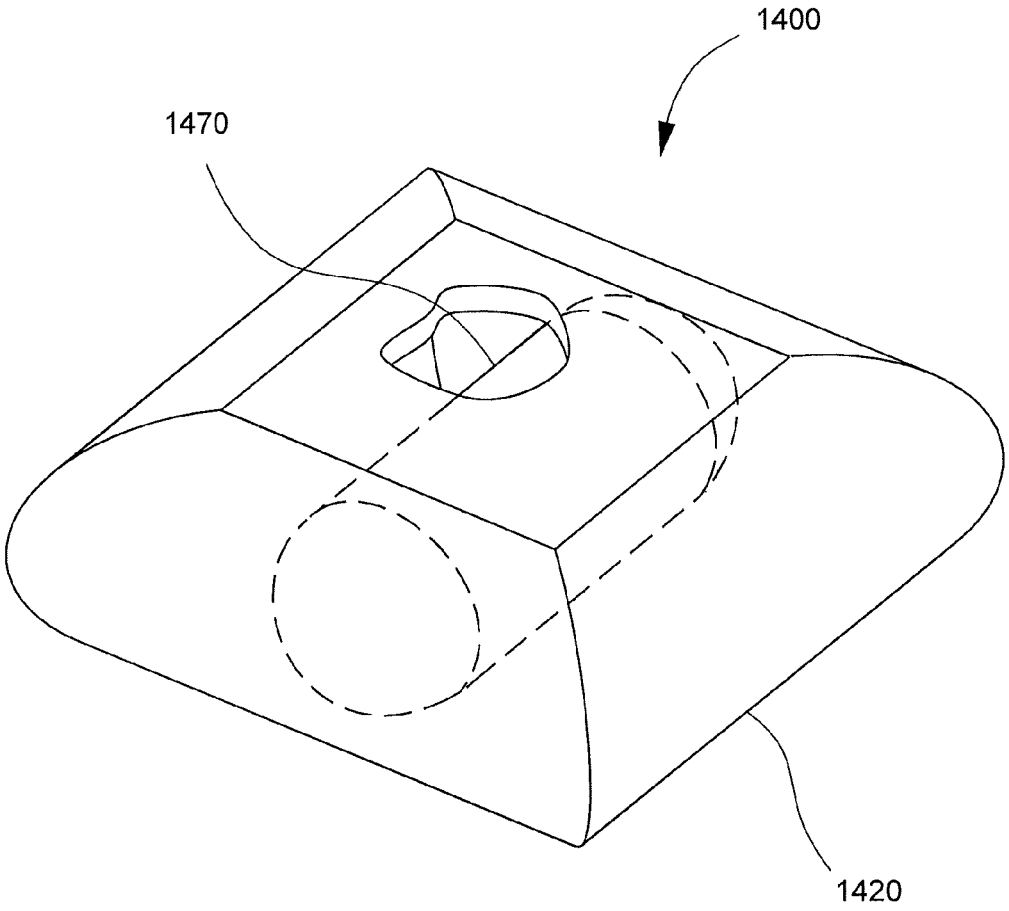
FIG. 26 is a top perspective view showing a fourteenth preferred embodiment of a tumbling toy vehicle with a square profile.

Although an elongated body is a preferred shape, certain inventive aspects can be applied to other shapes. As an example, FIG. 25 shows another embodiment, tumbling toy vehicle 1300, to include triangular body 1320 and spherical rolling mass 1370. Outer contact surface 1330 is effectively cambered from left to right to provide a means for a directional bias during end-over-end tumbling. As another example, FIG. 26 shows another embodiment, tumbling toy vehicle 1400, to include body 1420 and rolling mass 1470. Body 1420 is a shell with a square profile and fully rounded edges. Rolling mass 1470 is shaped like a capsule (cylinder with fully rounded ends) and can roll about its longitudinal axis and rotate about an axis normal to its longitudinal axis. More complex geometric shapes than triangles and squares can be employed with other embodiments.

Certain inventive aspects are adaptable to an elongated tumbling toy vehicle with a bias toward an upright neutral position on a level play surface. Consider tumbling toy vehicle 1500 of FIGS. 27A and 27B, another embodiment comprised of elongated body 1520 and rolling mass 1570. Referring now to FIG. 27B, center-of-gravity CG of tumbling toy vehicle 1500 is located below center-of-radius R of end 1532. Thus, tumbling toy vehicle 1500 is able to balance on end 1532 on a level play surface. Similar to previous embodiments, end-over-end tumbling occurs with sufficient incline. Elongated body 1520 is non-axisymmetric and outer contact surface 1530 is outwardly cambered from left to right to provide a means for directional bias, similar to other certain embodiments previously described.

Figure 27A:
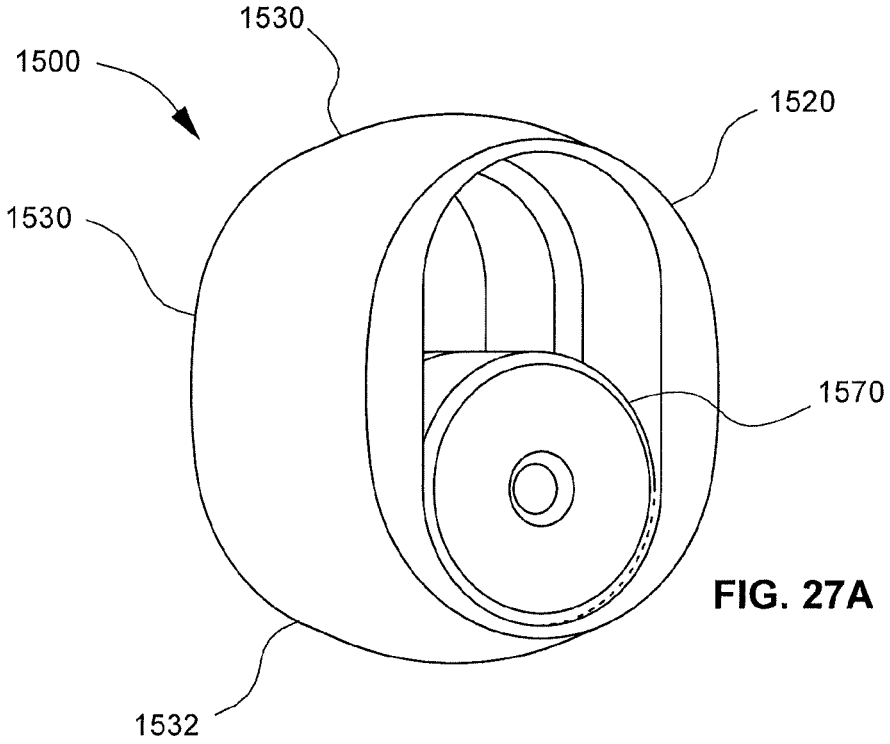
FIGS. 27A and 27B are front perspective and side plan views showing a fifteenth preferred embodiment of a tumbling toy vehicle with a bias for balancing in an upright position when at rest on a level play surface.
Figure 27B:
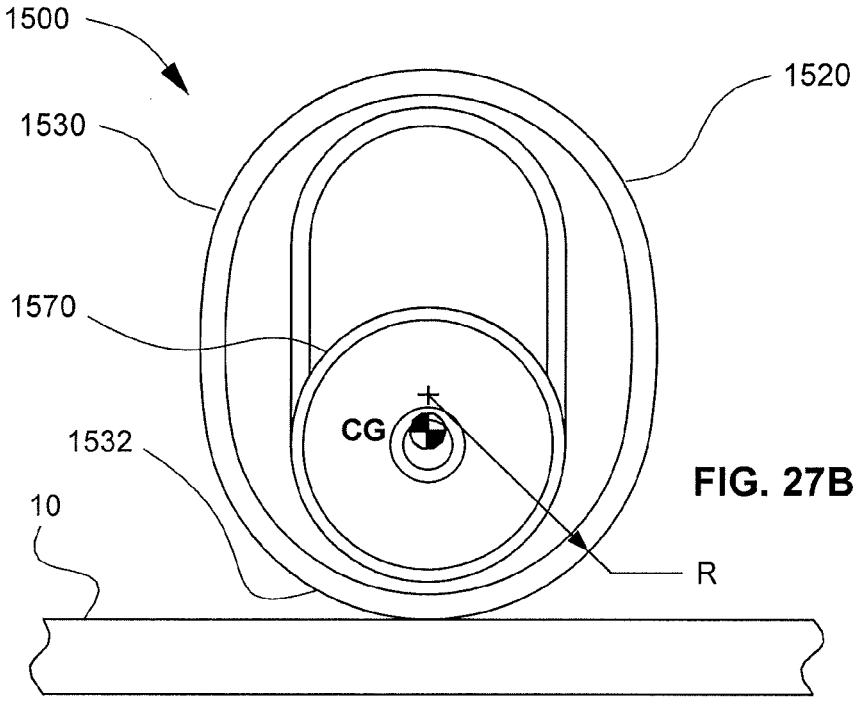
Figure 28A:
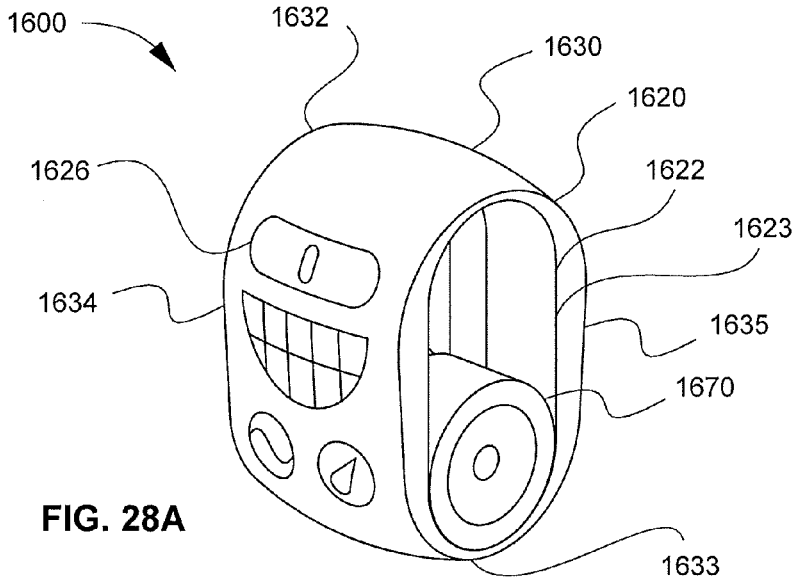
FIGS. 28A and 28B are front perspective and side plan views showing a sixteenth preferred embodiment of a tumbling toy vehicle, styled as a toy robot with a bias for balancing in a standing position when at rest on a level play surface.
Figure 28B:
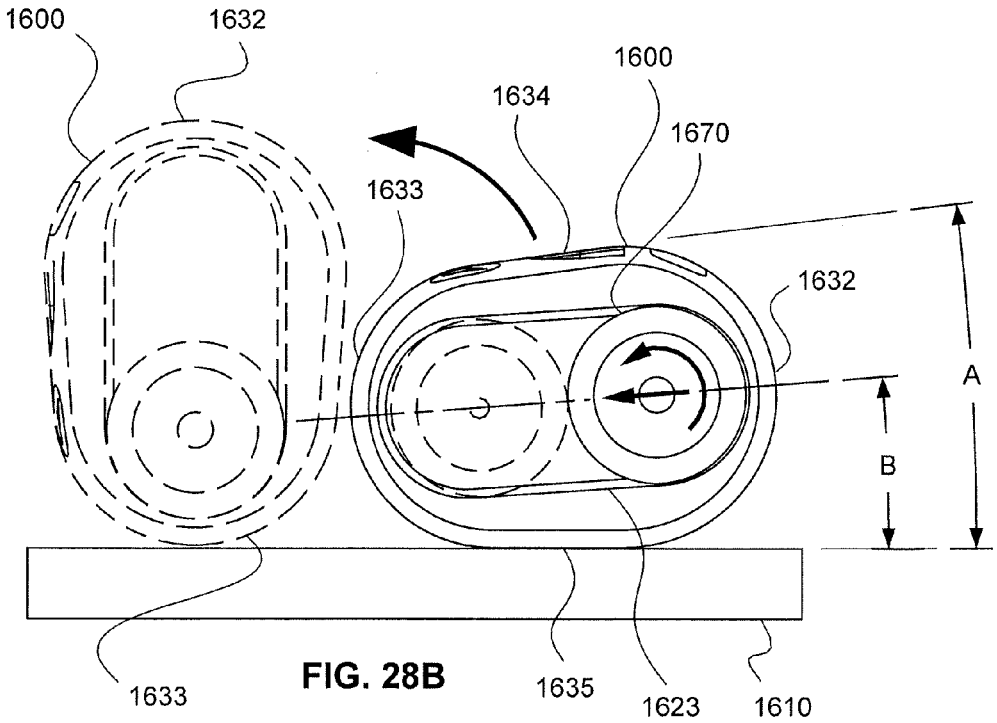

Like tumbling toy 1500 of FIGS. 27A and 27B, it may be desirable for a tumbling toy to have an upright neutral position, and it might be further desirable to have a character theme with designated upper portion, lower portion, front portion, or back portion. Tumbling toy 1600, shown in FIGS. 28A and 28B, is another embodiment styled as a toy robot having a generally upright or standing position. Similar to certain other embodiments, it is comprised of elongated body 1620 and rolling mass 1670. Elongated body 1620 is associated with upper end portion 1632, lower end portion 1633, front portion 1634, back portion 1635, lateral opening 1622, longitudinal passage 1623, and outer contact surface 1630. Graphic display 1626, associated with front portion 1634, establishes an exemplary toy robot theme. Similar to certain previous embodiments, end-over-end downward tumbling occurs with sufficient incline, wherein rolling mass 1670 travels longitudinally with respect to body 1620 within longitudinal passage 1623. Elongated body 1620 may be non-axisymmetric and outer contact surface 1630 may be outwardly cambered from left to right to provide a means for a directional bias to travel toward the lowest point on a play surface, as previously described. Referring specifically to FIG. 28B, tumbling toy vehicle 1600 is first shown in a substantially horizontal position on play surface 1610 as a result of tumbling to this position or manual placement. Longitudinal portions 1634 and 1635 are arranged such that elongated body 1620 is longitudinally tapered, as angle A indicates. Therefore, upper portion 1632 and lower portion 1633 have a different shape. Consequently, longitudinal passage 1623 is at an incline, consistent with angle B, though play surface 1610 is presently level. As indicated by the arrows associated with rolling mass 1670, rolling mass 1670 has a bias to roll toward lower end portion 1633. When rolling mass 1670 is proximate to lower end 1633, tumbling toy 1600 may advantageously rotate to an upright or standing position, as indicated by the large arcuate arrow and second position of tumbling toy 1600. Thus, a tumbling toy may be advantageously configured to have a bias for an upright or standing position.

Although many of the designs are shown as having a camber from left to right, and non-axisymmetric shape, certain inventive aspects of certain embodiments can be applied to other embodiments having an axisymmetric shape and some embodiments may not tend to travel to the lowest point of a play surface. For instance, the various rolling masses as described herein could be incorporated to prior art or other designs by way of example, or prior art designs could incorporate the repetitive cut outs or other features described herein. A flat play surface is shown throughout the specification, however, the tumbling toy vehicles of the present invention are adaptable to a variety of play surfaces to include an undulating play surface. Further, in addition to a change in orientation of a play surface, a flexible play surface could be contorted into different shapes resulting in a response from the tumbling toy vehicle.

From the description above, a number of advantages of certain embodiments become evident. Fulfilling a primary objective, many embodiments are provided with a non-axisymmetric shape, enabling the embodiments to operate on an incline without the need for a track providing lateral support. Fulfilling another objective, certain embodiments are cambered from left to right, providing the user with a means to control speed and direction on a play surface manipulated by a user. Certain embodiments, having medial surface portions that are cambered from left to right, are enabled to successfully travel down a long narrow stationary play surface (e.g., long narrow board) with an ongoing directional bias (self-centering) to the lowest point of the play surface, despite play surface anomalies or misaligned initial placement.

From the description above, a number of other advantages of certain embodiments of the present tumbling toy vehicle become evident: (a) two-piece assembly is simpler and less expensive to manufacture and assemble than tumbling toys comprised of three or more parts, (b) direct visualization of the rolling mass may provide visual appeal and provides additional educational value for users considering the working mechanism for at least some embodiments, (c) as the design is designed for maneuverability and stability, it provides users an educational opportunity to consider vehicle dynamics.

Although the description above contains much specificity, this should not be construed as limiting the scope of the embodiments, but merely providing illustrations of some of many possible embodiments. It is essential that the mass move relative to the elongated body and a rolling mass is pervasively taught throughout the discussion. However, other means for movement can be used to provide relative movement, to include sliding of the mass relative to an elongated body. Numerous embodiments reflect lesser degree of curvature medially from left to right; however, curvature might be a constant or be greater medially than laterally. Numerous embodiments are shown with features designed to reduce weight, increase visibility, and/or facilitate assembly, however, these features are not limitations to certain inventive aspects, and similar embodiments may be constructed to include a movable mass completely enclosed, substantially completely enclosed, and/or at least partially enclosed within an elongated body.

Thus the scope of the embodiments should be determined by the appended claims and their legal equivalents, rather than the examples given.

The invention claimed is:

1. A tumbling toy vehicle comprised of an elongated body and a rolling mass, wherein the rolling mass is constrained to move longitudinally with respect to the elongated body, wherein the elongated body comprises a medial plane and a central longitudinal axis, wherein the central longitudinal axis lies in the medial plane, wherein the medial plane divides the elongated body into symmetrical right and left portions, and wherein at least a portion of the elongated body has an outward camber from left to right to provide a directional bias toward an incline with a lateral component on a user manipulated play surface, wherein the outward camber has a center of curvature that lies on the medial plane, wherein the outward camber and the center of curvature are on opposite sides of the central longitudinal axis.

2. A tumbling toy vehicle comprised of an elongated body and a movable mass, wherein the elongated body comprises a medial plane, wherein the medial plane divides the elongated body into symmetrical right and left portions, wherein the movable mass moves longitudinally with respect to the elongated body, wherein the elongated body is non-axisymmetric and at least a portion of the elongated body is outwardly cambered from left to right with a center of curvature outside the elongated body.

3. A tumbling toy vehicle comprising an elongated body and a mass, wherein the mass moves along a central longitudinal axis relative to the elongated body, wherein the elongated body extends along the longitudinal axis and includes a first end outer surface, a second end outer surface, a first longitudinal outer surface, and a second longitudinal outer surface, wherein a medial plane divides the first longitudinal outer surface into right and left portions, wherein the first longitudinal outer surface is associated with a first transverse contour line which is orthogonal to the medial plane, wherein the first transverse contour line is outwardly cambered and extends from left to right, wherein a first reference line is normal to the first transverse contour line, wherein the first reference line intersects the medial plane at an intersection point, wherein the intersection point and the first transverse contour line are on opposite sides of the longitudinal axis.

4. A tumbling toy vehicle comprised of an elongated body associated with a longitudinal axis and a mass contained by and movable longitudinally with respect to the elongated body, wherein the elongated body has a first end, a second end, and a longitudinal portion, and a medial plane extending along the longitudinal axis and dividing the elongated body into right and left portions, wherein the first end comprises a convex outer surface having a pitch contour line lying in the medial plane and a lateral contour line extending right to left which is orthogonal to the pitch contour line where the lateral contour line intersects the pitch contour line, wherein the pitch contour line comprises a first curvature, wherein the lateral contour line comprises a second curvature and a center of curvature, wherein the first curvature has a greater degree of curvature than the second curvature.

5. A tumbling toy vehicle comprised of a non-axisymmetric elongated body associated with a medial plane extending along a central longitudinal axis of the elongated body and dividing the elongated body into right and left portions, and a mass contained by and movable longitudinally with respect to the elongated body, wherein the elongated body has a first end, second end, and a longitudinal portion, wherein the elongated body is associated with an outwardly cambered contour line extending from left to right; and the contour line having a first normal line extending from a first point along the contour line and a second normal line extending from a second point along the contour line, wherein the first normal line intersects the medial plane at a first location and the second normal line intersects the medial plane at a second location, wherein the second location is spaced apart from the first location.

6. A tumbling toy vehicle comprised of an elongated body having a medial plane dividing the elongated body into right and left portions and a longitudinal axis lying in the medial plane, and a mass movable longitudinally with respect to the elongated body, wherein the elongated body has a first end, a second end, and a longitudinal portion, wherein the first end comprises a first outwardly cambered contour line within the medial plane and a second outwardly cambered contour line extending from left to right orthogonal to the first outwardly cambered contour line, wherein the first outwardly cambered contour line and second outwardly cambered contour line have different curvatures.

7. A tumbling toy vehicle as in claim 4, wherein the right and left portions are symmetrical.

8. A tumbling toy vehicle as in claim 5, wherein the right and left portions are symmetrical.

* * * * *